US007261494B2

(12) United States Patent
Stankus et al.

(10) Patent No.: US 7,261,494 B2
(45) Date of Patent: Aug. 28, 2007

(54) TRUSS SHOE

(75) Inventors: John C. Stankus, Canonsburg, PA (US); John G. Oldsen, Butler, PA (US); Demrey G. Brandon, Pittsburgh, PA (US); Arthur J. Craven, Grand Junction, CO (US); Jeffrey J. Stankus, Canonsburg, PA (US)

(73) Assignee: Jennmar Corporation, Pittsburgh, PA (US)

( * ) Notice: Subject to any disclaimer, the term of this patent is extended or adjusted under 35 U.S.C. 154(b) by 0 days.

(21) Appl. No.: 11/064,426

(22) Filed: Feb. 23, 2005

(65) Prior Publication Data

US 2005/0201837 A1 Sep. 15, 2005

Related U.S. Application Data

(60) Provisional application No. 60/576,975, filed on Jun. 4, 2004, provisional application No. 60/548,363, filed on Feb. 27, 2004.

(51) Int. Cl.
*E21D 21/00* (2006.01)

(52) U.S. Cl. ..... 405/288; 405/302.1; 405/302.2; 405/259.1

(58) Field of Classification Search ..... 405/259.1, 405/288, 302.1, 302.2; 52/92.2, 703; 299/11
See application file for complete search history.

(56) References Cited

U.S. PATENT DOCUMENTS 4,395,161 A * 7/1983 Wilson et al. ..... 405/302.1
4,498,816 A * 2/1985 Korpela et al. ..... 405/259.1
4,596,496 A 6/1986 Tyrell et al.
4,630,974 A * 12/1986 Sherman ..... 405/288
4,699,547 A * 10/1987 Seegmiller ..... 405/288
4,749,310 A * 6/1988 White ..... 405/288
4,934,873 A * 6/1990 Calandra, Jr. ..... 405/288
4,946,315 A * 8/1990 Chugh et al. ..... 405/288

(Continued)

FOREIGN PATENT DOCUMENTS

CA 2313933 * 1/2001

OTHER PUBLICATIONS

DSGI Ground Support>Products, "Trusses and Utilities", 1998, p. 1, http://www.dywidag-systems.com/groundsupport/docs/products.php?content=D1.1 May 7, 2003.

*Primary Examiner*—Frederick L. Lagman
(74) *Attorney, Agent, or Firm*—The Webb Law Firm

(57) ABSTRACT

A truss shoe for a roof support system includes a base member having a bearing surface and, optionally, an end having a sweeping radius for ease of moving the truss shoe into an installation position, a bolt receiving section having a bore hole, a cable engaging section, and an intermediate section. The cable engaging section includes an opening and a slot and, optionally, a lock-in device that allows a cable to move through the slot into the opening and retains the cable in the opening. In another non-limiting embodiment of the cable engaging section, the cable is moved into an assembly mounted in a conical-shaped passageway of the cable engaging section to compress the assembly around the cable. The intermediate portion includes a pair of side flanges on the base member between the bore and the opening and, optionally, a rib between the pair of side flanges.

23 Claims, 13 Drawing Sheets

U.S. PATENT DOCUMENTS 4,960,348 A * 10/1990 Seegmiller ..... 405/259.1
5,026,217 A 6/1991 Seegmiller
5,176,473 A 1/1993 Seegmiller
5,302,056 A * 4/1994 Calandra et al. ..... 405/288
5,466,095 A * 11/1995 Scott ..... 405/302.2
5,544,982 A * 8/1996 Seegmiller ..... 405/288
5,755,535 A * 5/1998 Fox ..... 405/288
5,913,641 A * 6/1999 Long ..... 405/302.2
5,967,703 A 10/1999 Stankus et al.
6,619,888 B2 9/2003 Calandra, Jr. et al.
6,884,005 B1 * 4/2005 Seegmiller ..... 405/288
2005/0115188 A1 * 6/2005 Wallstein et al. ..... 52/698

* cited by examiner 994
880

942
946
948
956
952
996
998
944
954
955
949
950
848
46

980
983
982
952
990
992
72

TRUSS SHOE

CROSS REFERENCE TO RELATED APPLICATION

This application corresponds to U.S. Provisional Application Ser. No. 60/548,363, filed Feb. 27, 2004, entitled "TRUSS SHOE" (hereinafter also referred to as "PA 60/548,363") and U.S. Provisional Application Ser. No. 60/576,975, filed Jun. 4, 2004, entitled "TRUSS SHOE" (hereinafter also referred to as "PA 60/576,975"). This application claims the benefit of the filing date of PA 60/548,363 and PA 60/576,975, and the disclosures of PA 60/548,363 and PA 60/576,975 are hereby incorporated by reference.

BACKGROUND OF THE INVENTION

1. Field of the Invention

This invention relates to a truss shoe and, more particularly, to a truss shoe for a mine roof support truss system to produce a desired tension for supporting a wide variety of mine roof conditions.

2. Description of Related Art

Truss-type mine roof supports are well known in the art of supporting the roof of an underground passageway, such as a mine passage. A basic truss system includes one or more rods extending horizontally the width of the mine passage adjacent the roof and connected at their ends to anchor bolts which extend at an angle adjacent the ribs of the passageway into the rock strata over a solid pillar. The rods are tensioned and vertical components of compressive forces are transmitted into the solid material over the pillars, as opposed to the unsupported rock material immediately above the passageway.

With this arrangement, a truss system shifts the weight of the rock strata from over the mined-out passageway back onto the pillars. The desirability of truss systems has been enhanced by the development of roof bolting machines that can convert from vertical to angle drilling. Conventionally, holes are drilled into the mine roof at a 45° angle from horizontal adjacent to the mine rib so that the holes extend into the supported rock structure over a pillar. To ensure adequate anchorage over the pillar at the rib line, the bolts extend up to six or seven feet into the supported structure over the pillar.

Once the angle holes are drilled into the strata over the pillars at the rib line, anchor bolts are inserted into the drilled holes and are secured in place using mechanical expansion shell assemblies and/or with a resin made from a mixture of a resin component and an epoxy component. This arrangement ensures adequate anchorage over the rib line for bolts that extend in length up to six feet (1.8 meters) or greater. Before the bolts are inserted in the drilled holes, truss shoes or bearing blocks are positioned on the bolt at the emergent end of the bolt from the hole. As the bolts are securely anchored in the bore holes, the bearing surfaces of the truss shoes or bearing blocks are compressed into engagement with the mine roof.

For an uneven mine roof or a roof having severely potted areas, the truss shoe or bearing block preferably has sufficient bearing surface to contact the mine roof so that the truss shoe is correctly positioned for engagement with the horizontal truss members. Once the truss shoes or bearing blocks are securely positioned at the mine roof adjacent the ribs, the horizontal truss members are assembled and connected to the truss shoes. The truss members are tightened to a preselected torque to exert tension on the truss members so that the weight of the rock strata over the mined out area beneath the roof is shifted along the horizontal truss members upwardly into the solid rock strata over the pillars at the ribline.

A wide variety of truss hardware is commercially available to form a truss system between the anchored angle bolts. The truss hardware is connected under tension to the truss shoes that are held tightly against the mine roof by the anchored angle bolts.

U.S. Pat. No. 5,302,056 discloses such a truss system. In that system, there is provided a roof support for an underground passageway that includes first and second truss brackets. The first and second truss brackets are secured to the roof of the underground passageway adjacent to opposing ribs of the underground passageway. The truss brackets each include a roof engaging surface positioned in contact with the roof and a truss supporting arm member extending from the roof engaging surface. The truss supporting arm member is positioned horizontally relative to the roof engaging surface. A truss arrangement extends between the first and second truss brackets for applying an uplifting force to the roof to support the roof above the passage. The truss arrangement includes a pair of U-shaped members releasably engaged to the first and second truss brackets. Each of the U-shaped members is supported in a vertically hanging position by the supporting arm members. The arm members each include an end portion arranged to retain the U-shaped member for horizontal movement on the truss bracket. Tension is applied to the truss members, with the U-shaped members engaged to the truss brackets to apply an uplifting force to the roof.

DYWIDAG-Systems International (DSI) manufactures and sells a bar cable truss system including a pair of truss shoes, a pair of inclined bolts, and a truss assembly. Each truss shoe attaches to a roof through an inclined bolt. Each truss shoe includes a surface for contacting the roof and a truss supporting member. The truss assembly extends between the truss supporting members of the pair of truss shoes for applying an uplifting force to the roof to support the roof above the passage. The truss assembly includes a pair of cables engaged to the truss shoes through a slot and opening configuration in the truss supporting member.

Although the truss shoes presently available for use with mine roof support systems are acceptable for their intended purposes, it is appreciated by those skilled in the art that providing additional truss shoe designs provide a wider selection of truss shoes for use with the mine roof support system to provide support for different types of mine roof surface conditions.

SUMMARY OF THE INVENTION

The invention relates to a roof support for an underground passageway that includes first and second truss shoes. Facilities are provided for securing the first and second truss shoes to the roof of the underground passageway adjacent to opposing ribs of the passageway. The truss shoes each include a roof engaging (or bearing) surface for positioning in contact with the roof and a truss supporting member. The truss supporting member is positioned horizontally relative to the roof engaging surface. Truss means extend between the truss supporting members of the first and second truss shoes for applying an uplifting force to the roof to support the roof above the passageway. The truss means include one or more cables releasably engaged to the first and second truss shoes through slot and opening configurations of the truss supporting members. Each opening includes a chamfered receiving area for receiving a spherical washer positioned on an end of the cable. Further, means are provided for applying tension to the truss members with the cables engaged to the truss shoes to apply an uplifting force to the roof. Each truss shoe may include a pair of side flanges extending from a base of the truss shoe. Each of the side flanges terminates in a lip. A rib may extend between the pair of side flanges. The base of each truss shoe can include an arcuate end.

The invention relates to a truss shoe for use in a mine roof support system. In one non-limiting embodiment of the invention, the truss shoe includes a base member including a bearing surface for engaging a mine roof; a body extending from the base member, the body portion including a bolt receiving section having a bore, the bore extending through the bolt receiving section and the base member; a cable engaging section spaced from the bolt receiving section and having an opening therethrough to receive a portion of a cable; and an intermediate body portion between the bolt receiving section and the cable engaging end portion.

The invention further relates to a truss shoe including a base having a first major surface and an opposite second major surface, a first side and an opposite second side with the first side longer than the second side, and a first end joining the first side and the second side, the first end having a curved peripheral surface, and an opposite second end joining the first and the second sides. The cable engaging section includes a flange mounted on the first major surface adjacent to and spaced from the second side, the flange extends away from the first major surface and has an opening and a slot extending away from the opening and the first major surface to outer surface of the flange. The bore of the bolt receiving section extends at an angle through the bolt receiving section and the base member. The first major surface of the first end is larger than the second major surface of the second end, and peripheral edge of the first end is curved to provide a sweeping radius.

In a non-limiting embodiment of the truss shoe of the invention, the connection of the first side and the first end is a first transition area and the connection of the second side and the first end is a second transition area, and at least one of the transition areas has a continuation of the sweeping radius. In another non-limiting embodiment of the invention, the cable engaging section includes a cable lock-in device. The lock-in device includes a flexible strip member having one end secured to the flange adjacent to one surface of the slot such that body of the strip member extends at an angle into the slot toward opposite surface of the slot.

In another non-limiting embodiment of the invention, the opening of the cable engaging section is a passageway and the cable engaging section includes a housing extending upward from the base member and having a first open end facing the bolt receiving section and an opposite second open end with the passageway between the first end and the second end, the passageway having decreasing distance between wall portions as the distance from the first open end increases to provide a passageway having a predetermined interior surface configuration. A wedge assembly having at least two segments are mounted in the passageway and an expander mounted in the wedge assembly and secured therein. A retainer is ring mounted in the groove and secured over the first end opening, the retainer ring having an opening sized to retain the wedge assembly in the passageway while allowing the expander to pass therethrough.

The invention further relates to a method of making and using a truss shoe for a mine roof and includes the steps of providing a base member having a bearing surface and an opposite surface having a bolt receiving section and a housing spaced from the bolt receiving section, the housing having a first open end facing the bolt retention end portion and a second opposite open end, with the first open end and the second open end interconnected by a passageway, wherein the open area of the passageway decreases as the distance from the first open end increases; and inserting a wedge assembly in the passageway. The wedge assembly having a center hole having an expander therein and an outer surface sized and configured to slide completely through the first opening and not completely through the second opening. Thereafter mounting a retention member over the first opening to capture the wedge assembly in the passageway. The retaining member having an opening to pass the expander.

DETAILED DESCRIPTION OF THE INVENTION

Figure 1:
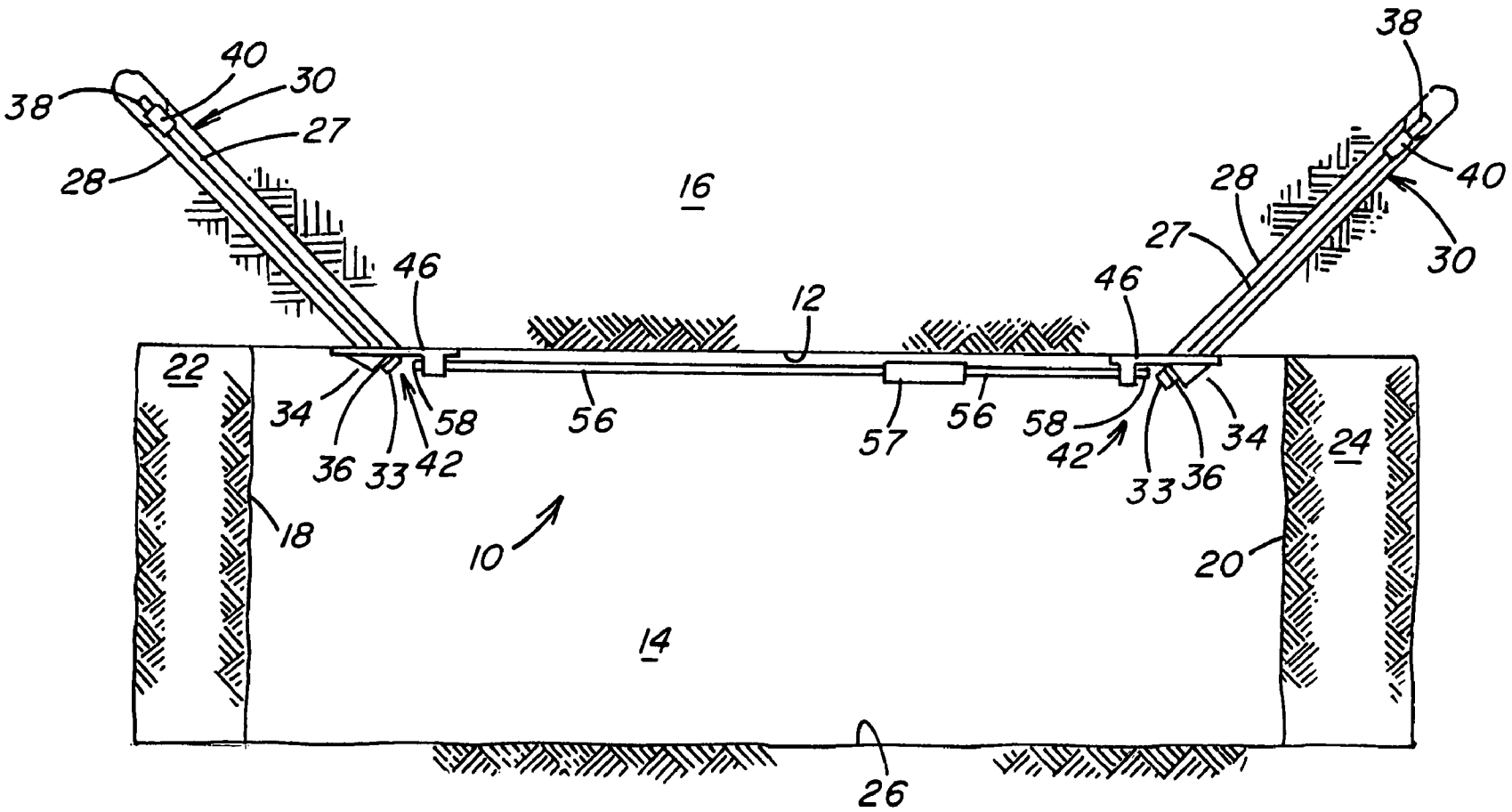
FIG. 1 is a side sectional view of an underground passage having a truss system installed according to the present invention.

A complete understanding of the invention will be obtained from the following description when taken in connection with the accompanying drawing figures wherein, unless indicated otherwise, like reference characters identify like parts throughout. Further, the terminology used herein to discuss the non-limiting embodiments of the invention is for purposes of description and not of limitation.

For purposes of the description hereinafter, the terms "upper", "lower", "right", "left", "vertical", "horizontal", "top", "bottom", "lateral", and derivatives thereof, shall relate to the invention as it is oriented in the drawing figures. However, it is to be understood that the invention can assume various alternative variations and step sequences, except where expressly specified to the contrary. It is also to be understood that the specific devices and processes illustrated in the attached drawings, and described in the following specification, are simply exemplary non-limiting embodiments of the invention. Hence, specific dimensions and other physical characteristics related to the embodiments disclosed herein are not to be considered as limiting. Further, all numbers expressing dimensions, physical characteristics, and so forth, used in the specification and claims are to be understood as being modified in all instances by the term "about". Accordingly, unless indicated to the contrary, the numerical values set forth in the following specification and claims can vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more and ending with a maximum value of 10 or less, e.g., 1 to 6.7, or 3.2 to 8.1, or 5.5 to 10.

Referring to FIG. 1, there is illustrated a truss system 10 for supporting a roof 12 above an underground passageway 14 cut in a rock formation 16 by conventional mining methods to extract solid material, such as coal, in a mining operation. The passageway 14 is defined by oppositely positioned side walls 18 and 20 formed by ribs or pillars 22 and 24 that extend between the roof 12 and a floor 26. The portion of the rock formation 16 above the roof 12 is unsupported. The truss system 10 incorporating features of the invention is installed transversely across the passageway 14 adjacent the roof 12 to provide an uplifting force through the unsupported roof 12 in a manner which will be described later in greater detail by which the weight of the rock formation 16 above the roof 12 is shifted horizontally and redirected to the rock formation 16 supported by the pillars 22 and 24.

As is appreciated, the truss system incorporating features of the invention is not limited to providing an uplifting force to the roof of a passageway and can be used to apply a supporting force to the walls of the passageway.

The truss system 10 is secured to the mine roof 12 by elongated roof bolt assemblies 27 inserted in bore holes 28 drilled at an angle through the surface of the roof 12 for a predetermined length into the rock formation 16 which is supported by the solid pillars or ribs 22 and 24. In one non-limiting embodiment of the invention, the bore holes 28 are drilled at a 45° angle for a distance of six feet (1.8 meters) or greater into the mine roof 12 from points spaced approximately two feet (0.33 meters) from the respective side walls 18 and 20 to end points supported by solid material above the pillars 22 and 24.

One non-limiting roof bolt assembly, e.g., roof bolt assembly 30, that can be used in the practice of the invention and not limiting thereto, includes an elongated roof bolt, e.g., the roof bolt 27, having an enlarged head 33 with a washer 36 at one end portion designated by the number 34 and an opposite threaded end portion 38. A mechanical expansion shell assembly generally designated by the numeral 40 is threadably engaged to the threaded end portion 38 of the bolt 27. As is well known, upon rotation of the roof bolt 27, the shell assembly 40 is expanded into gripping engagement with the wall of the bore hole 28 to exert tension on the bolt 27, with the end portion 34 bearing against the mine roof 12. To increase the anchorage of a roof bolt assembly 30 within the bore hole 28, resin can be used in combination with the roof bolt assembly 30 when it is installed, e.g. but not limiting to the invention, as disclosed in U.S. Pat. No. 6,619,888, which patent is hereby incorporated by reference. The use of resin adds additional strength to the anchorage of the roof bolt assembly 30 in its respective one of the bore holes 28 when torque is applied to the end portion 34 of the bolt 27.

As is appreciated by those skilled in the art, the invention is not limited to the type of bolt assembly used to secure the truss shoes of the invention, e.g., truss shoe 42 (see FIGS. 2 and 3), against the roof 12 of the passageway 14 and any of the bolt assemblies known in the art can be used to secure the truss shoe of the invention to the roof of a passageway.

Prior to installation of the roof bolt assembly 30 in the bore hole 28, the roof bolt 27 is moved through bore 44 of the truss shoe or truss bracket or bearing block 42 (clearly shown in FIGS. 2 and 3, and discussed below) with the enlarged head 33 of the roof bolt 27 and the washer 36 engaging the truss shoe 42. The expansion shell assembly 40 can be threaded onto the threaded end portion 38 of the roof bolt 27 before the bolt is moved through the truss shoe 42 or after the roof bolt 27 is moved through the truss shoe 42. The roof bolt 27 having the expansion shell 40 is then inserted upwardly into the angled bore hole 28 in the rock formation 16. The roof bolt assembly 30 is advanced into the bore hole 28 so that the enlarged head 33 of, and the washer 36 on, the roof bolt 27 engages the truss shoe 42 to urge bearing or bottom surface 46 of the truss shoe 42 (see FIG. 2) into contact with the roof 12. When the bearing surface 46 is satisfactorily seated in contact with the roof 12, a torque is applied to the end portion 34 of the roof bolt assembly 30 to expand the shell assembly 40 to anchor the roof bolt assembly 30 in its respective one of the bore holes 28 in the roof 12.

As can be appreciated, the invention is not limited to the manner in which the truss shoe of the invention is secured against the passageway roof 12. For example and not limiting to the invention, the techniques disclosed in U.S. Pat. No. 6,619,888 can be used to set a bolt in each of the bore holes 28 in the rock formation 16. After the bolt is set in the rock formation, the bore hole, e.g., the bore hole 44 of a truss shoe, e.g., the truss shoe 42, is passed over the threaded end of the bolt extending out of the bore hole 28 and a nut threaded onto the threaded end of the bolt to secure the truss shoe against the roof 12 of the passageway 14.

Figure 2:
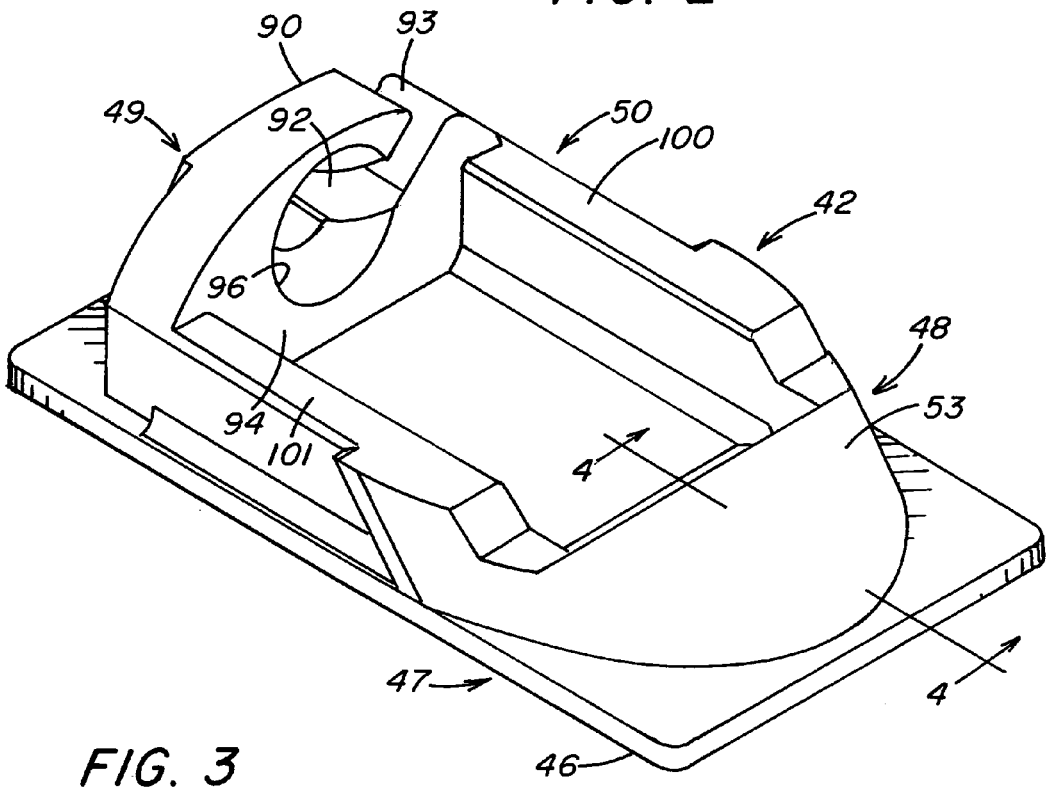
FIG. 2 is an orthogonal view of a non-limiting embodiment of a truss shoe according to the present invention.
Figure 3:
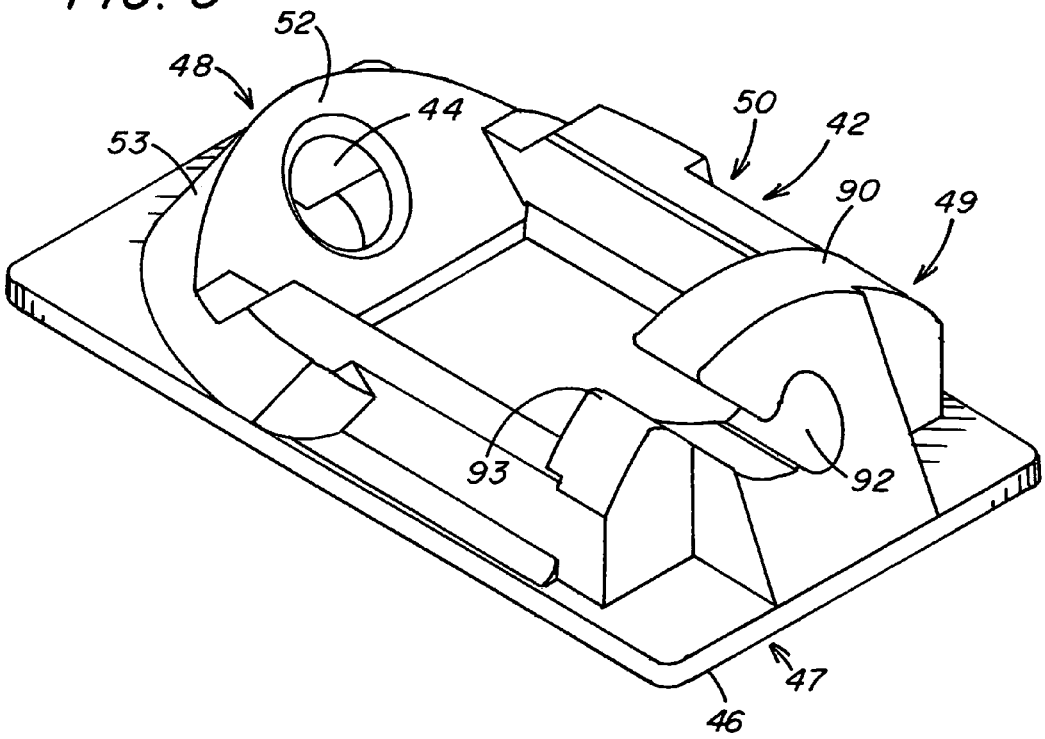
FIG. 3 is another orthogonal view of the truss shoe shown in FIG. 2.

With specific reference to FIGS. 2 and 3, in one non-limiting embodiment of the invention, the truss shoe 42, for ease of discussion and not limiting thereto, has a base member 47 having the bearing surface 46, and opposite to the bearing surface 46 and extending upwardly and/or outwardly from the base member 47 having a generally rectangular shape with rounded corners, the truss shoe 42 includes a bolt receiving section or end portion 48 having the bore 44, a truss or cable engaging section or end portion 49 spaced from the bolt receiving section 48 and positioned generally perpendicular to the bearing surface 46, and an intermediate section or body portion 50 between the bolt receiving section 48 and the cable engaging section 49. As is discussed in more detail below, the cable engaging section 49 is configured for receiving end portions of the truss system 10 that extend horizontally between a pair of truss shoes of the invention.

In the preferred embodiment of the truss shoe of the invention, the truss shoe having the base member 47, the bolt receiving section 48, the intermediate section 50, and the cable engaging section 49 is a formed, one-piece truss shoe. The invention is not limited to the manner in which the truss shoe is formed, e.g. and not limiting to the invention, the truss shoe of the invention can be cast or machined. The invention further contemplates individually forming the base member 47, the bolt receiving section 48, the cable engaging section 49, and the intermediate section 50, and thereafter securing the sections on the base member 47 using adhesives and/or mechanical securing arrangements, e.g., nails, screws, nuts, and bolts. Further, as can be appreciated, the invention is not limited to any type of material to make the truss shoes, however, the material selected should provide sufficient structural stability to provide the roof support required and to meet all safety standards. In the preferred practice of the invention, the truss shoe is made of metal, e.g., steel. Still further, as can be appreciated, the invention is not limited to the dimensions of the truss shoes of the invention, and the shoe should be large enough to provide a bearing surface 46 having an area sufficient to span recesses in the roof 12 (see FIG. 1). More particularly, in many underground passageways or excavations, the surface of the roof 12 can be very uneven or exhibit severely potted areas formed during the excavation operation. Therefore, it is recommended that the truss shoe 42 have a bearing surface 46 of a sufficient area (e.g., at least 36 square inches (232 square centimeters) and/or 4 inches (10.2 centimeters) by 10 inches (25.4 centimeters)) to prevent the base member 47 from becoming distorted or pulled into a recess in the roof 12 when the roof bolt 27 is tensioned. While the truss shoe 42 is shown in FIG. 1 with the base member 47 in a substantially horizontal position, it is appreciated by those skilled in the art that it is not uncommon for the truss shoe 42 to be substantially inclined or displaced from the preferred horizontal position. The construction of the truss shoe 42 of the present invention assures successful installation of the truss system 10 for a wide variety of roof conditions.

Referring back to FIGS. 2 and 3, the discussion is directed to the bore hole 44 in the bolt receiving section 48 of the truss shoe 42. As is appreciated by those skilled in the art and as discussed, the bore holes 28 are drilled into the rock formation 16 at an angle so that threaded end portion 38 of the roof bolt 27 extends over a pillar, e.g., one of the pillars 22 and 24, and the end portion 34 of the bolt 27 extends out of the roof 12 of the underground passageway 14. To provide for full surface contact between surface 52 of housing 53 containing the bore hole 44 (clearly shown in FIG. 3) and the washer 36, and between the enlarged head 33 of the bolt 27 and the washer 36, a plane containing the surface 52 of the housing 53 and the bearing surface 46 of the truss shoe 42 subtend an angle the same as or similar to the angle subtended by center line of the bore hole 28 and the plane of the roof 12. Although not limiting to the invention, the angle is usually 45°.

Figure 4:
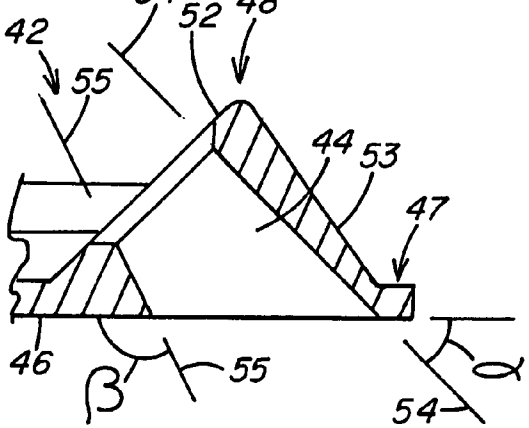
FIG. 4 is a view taken along lines 4-4 of FIG. 2.

With reference to FIGS. 3 and 4, the bore hole 44 adjacent the surface 52 has an enlarged opening for ease of inserting the roof bolt into the bore hole 44 of the truss shoe 42. For example and not limiting to the invention, the bore hole 44 at the surface 52 of the housing 53 has a diameter of 1.75 inches (4.45 centimeters); the diameter decreases for a distance of 0.188 inch (0.48 centimeter) to a diameter of 1.375 inches (3.49 centimeters). The shape of the bore 44 as it extends toward the bearing surface 46 changes from a circular configuration to an elliptical configuration so that the roof bolt 27 of the roof bolt assembly 30 as it is moved into the bore hole 28 in the roof 12 has some degree of free movement to accommodate those instances where the bearing surface 46 of the truss shoe 42 and the roof 12 are not parallel to one another. The conversion from a circular bore to an elliptical bore is not limiting to the invention. In one non-limiting embodiment of the invention, a portion of the bore hole 44 lying along line 54, shown in FIG. 4 and the bearing surface 46 subtend an angle $\alpha$ of 45°, whereas opposite wall of the bore hole 44 lying along line 55 and the bearing surface 46 subtend an angle $\beta$ of 60°. The interior wall portions of the bore 44 between the lines 54 and 55 are contoured to provide a seamless transition from line 54 to line 55 and to provide an elliptical opening for the bore hole 44 at the bearing surface 46 having a desired shape.

Figure 6:
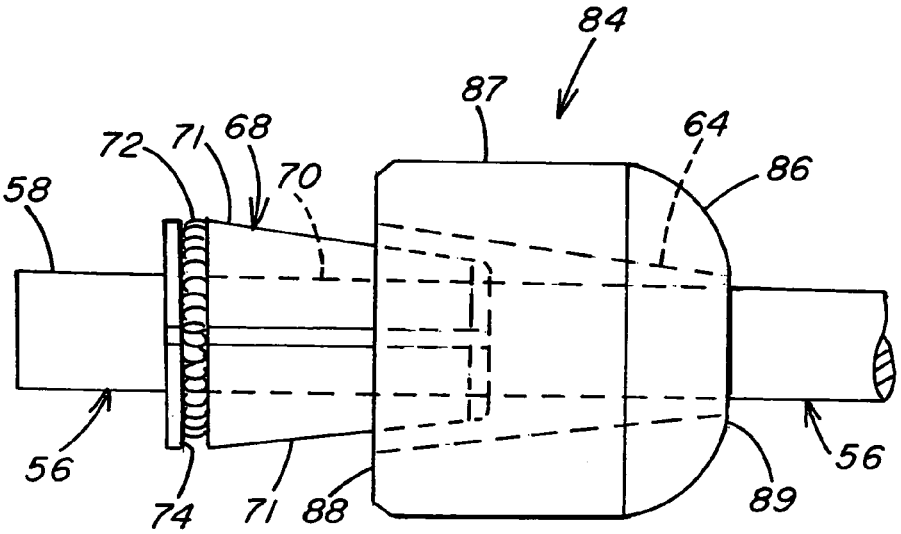
FIG. 6 is a side elevated view of another embodiment of a cable retention assembly.
Figure 5:
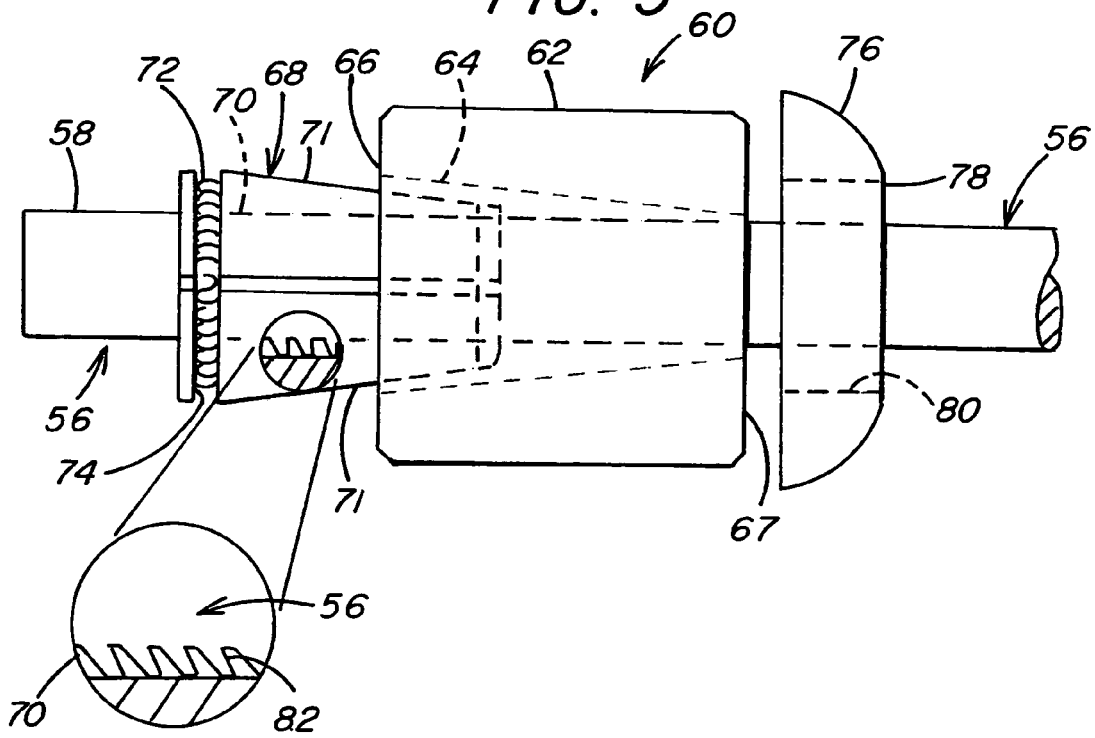
FIG. 5 a side elevated view of a cable retention assembly having an exploded interior view of the assembly for purposes of clarity.

Referring now to FIGS. 1, 5, and 6, the truss system 10 includes cables 56 that extend horizontally between the pair of truss shoes 42. One end of each of the cables 56 are joined by a coupler 57 or splice tube of the type used in the art, and the other end of the cable is joined to the cable engaging section 49 of the truss shoe 12 in any convenient manner, and preferably in the manners discussed herein. For example and with reference to FIG. 5, in one non-limiting embodiment of the invention, end portion 58 of the cable 56 is secured in a cable securing arrangement 60. The cable securing arrangement 60 includes a spherical collar 62 having a cone-shaped passageway 64 having a larger diameter at end 66 than at opposite end 67 to receive cable retainer 68 having a cone-shaped outer surface sized to fit into the cone-shaped passageway 64, and a circular passageway 70 to receive the cable 56. For ease of inserting the cable into the passageway 70, the cable retainer 68 is made up of two or three or more, and preferably 2 or 3 segments or parts 71, joined together by a spring band or rubber O-ring 72 mounted in groove 74 as shown in FIG. 5. The cable securing arrangement 60 further includes a washer 76 having a spherical surface 78 and an inside passageway 80. Although not limiting to the invention, the diameter of the passageway 80 of the washer 76 is sized to pass cable diameters in a predetermined range, e.g. and not limiting to the invention, ½ to 1 inch (1.72 to 2.54 centimeters), e.g., 0.60 inch (0.10 centimeter). With this arrangement, cable securing arrangements 60 having different sized cone-shaped passageways 64 within a range can be used with one size washer 76. Optionally the inner surfaces of the passageway 70 of the cable retainer 68 can be provided with a rough surface, e.g. and not limiting to the invention, with teeth 82, angled toward the end of the retainer 68 having the larger outside diameter to engage the surface of the cable 56 and secure it in position in the cable securing arraignment 60.

As can be appreciated, the invention is not limited to any particular cable securing arrangement. For example and not limiting to the invention, shown in FIG. 6 is another non-limiting cable securing arrangement designated by the number 84 that can be used in the practice of the invention. The cable securing arrangement 84 of FIG. 6 is similar to the cable securing arrangement 60 of FIG. 5 except that the spherical washer 76 and the collar 62 are unitized to provide the cable securing arrangement 84 having a spherical end 86 and a body 87 having a circular outer surface and the cone-shaped passageway 64 extending from end 88 to end 89 of the body 87.

Referring back to FIGS. 2 and 3, the discussion is directed to securing the cable 56 having the cable securing arrangement 60 or 84 attached to one end of the cable to the cable engaging section 49 of the shoe 42. The cable engaging section 49 includes a flange 90 having an opening or cavity 92 and a slot or access opening 93 sized such that a portion of the cable downstream of the cable securing arrangement 60 or 84 is moved through the slot 93 into the opening 92, and thereafter the cable is pulled away from the truss shoe to move the cable 56 through the opening 92 to move the spherical surface 78 of the washer 76 of the cable securing arrangement 60, or the spherical end 86 of the cable securing arrangement 84 into contact with a side 94 of the opening 92 to contain the cable in the cable engaging section 49 of the truss shoe 42. The opening 92 is positioned to secure the cable 56 horizontally in position when the truss shoe 42 is secured to the roof bolt assembly 30 as discussed above.

Optionally and not limiting the invention thereto, the slot 93 of the cable engaging section 49 is preferably located offset from an axis running perpendicular from the base member 47. Side 94 of the opening 92 has a chamfered receiving area 96 configured to receive the spherical surface 78 of the washer 76 (see FIG. 5) or the spherical end 86 of the cable securing arrangement 84 (see FIG. 6) therein. The washer 76 and the body 87 of the cable securing arrangement 84 have a larger diameter than the opening 92 and slot 93, thus preventing the end portion 58 of the cable 56 from dislodging from the truss shoe 42 during and after installation.

During installation, one of the cables 56 is positioned such that the spherical surface 78 of the washer 76 (see FIG. 5) or the spherical end 86 of the cable securing arrangement 84 (see FIG. 6) is on the side 94 of the flange 90. A portion of the cable 56 downstream of the cable securing arrangement 60 or 84 is slid through the slot 93 into the opening 92. The cable 56 is held in place by the spherical surface 78 of the washer 76, or the spherical surface 86 of the cable securing arrangement 84 abutting the chamfered area 96. Additionally, with this arrangement, horizontal shifting movement of the cable 56 on the cable engaging section 49 of the truss shoe 42 is permitted during installation of the truss system 10. An end of a second one of the cables 56 is installed on the other one of the pair of truss shoes 42 in a similar manner. The ends of the two cables 56 are joined together by the coupler 57 and the cables properly tensioned. Once the truss system 10 is installed, if a force is applied to the truss system 10 causing the cables 56 to move or shift horizontally, the flange 90 of the spaced truss shoes 42 will prevent the cables 56 from becoming disengaged from its respective truss shoe 42.

The intermediate section 50 of the truss shoe 42 shown in FIGS. 2 and 3 includes a pair of spaced ribs 100 and 101 that extend from the cable engaging section 49 to the bolt receiving section 48 of the truss shoe 42. The ribs 100 and 101 provide structural stability to the truss shoe, e.g. but not limiting to the invention, prevent the bending and/or stretching of the base member 47. Although not limiting to the invention, the space between the ribs 100 and 101 provides a recess to receive the end 58 of the cable 56 and the cable securing arrangement 60 or 84.

Figure 7:
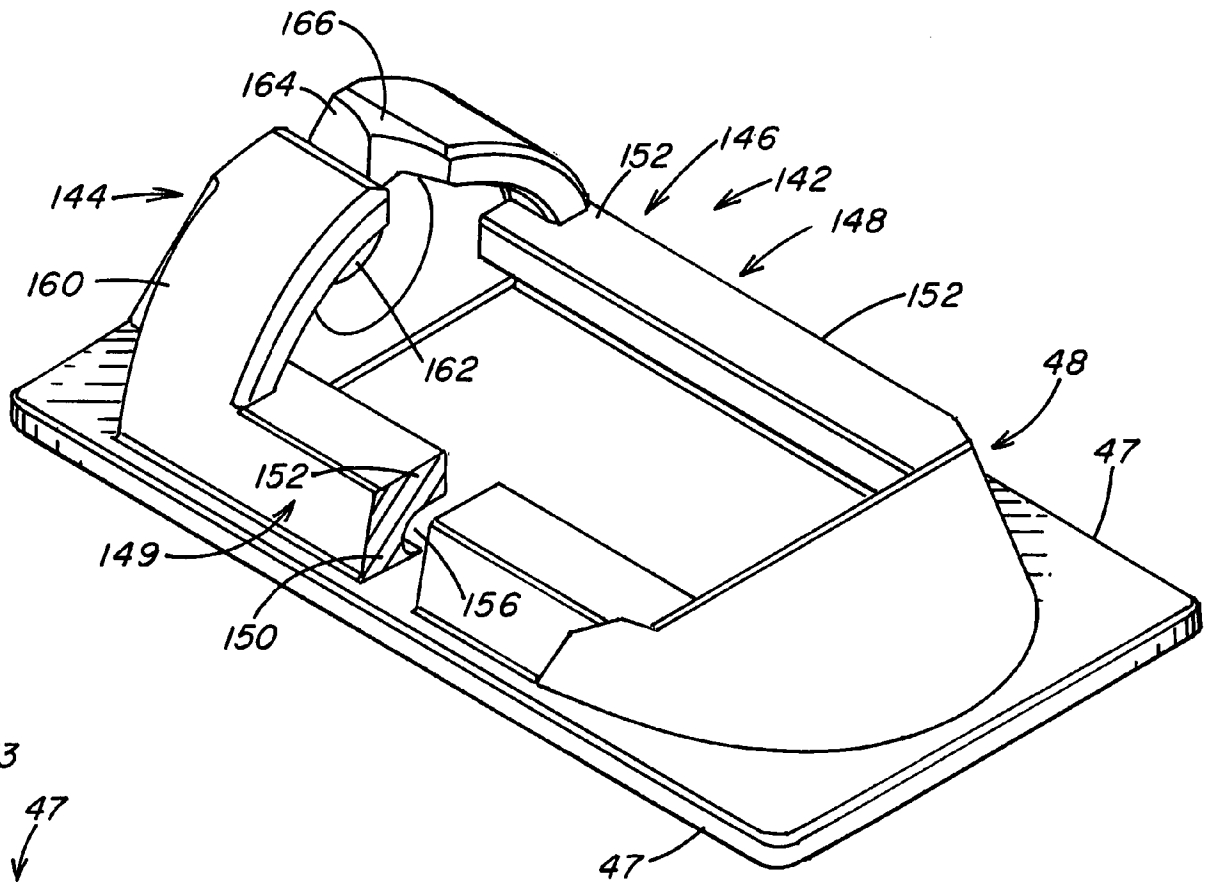
FIG. 7 is a perspective view of a second non-limiting embodiment of a truss shoe according to the present invention having portions removed for purposes of clarity.

FIG. 7 depicts a second non-limiting embodiment of a truss shoe of the invention designated by the number 142, which includes the base member 47, the bolt receiving section 48, cable engaging section or end portion 144, and intermediate body section 146. The intermediate body portion 146 has a pair of side flanges 148 and 149 extending substantially perpendicular from the base member 47 between the bolt receiving section 48 and the cable engaging section 144. Each of the side flanges 148 and 149 includes an elongated member 150 extending from the base member 47 and terminating in a lip 152 extending substantially perpendicular to the elongated member 150. Preferably, the lips 152 of the side flanges 148 and 149 extend towards each other to form an overhang on each side flange 148 and 149, with a recess 156 between the lip 152 and the underlying surface portions of the base member 47. The configuration of the overhangs and recesses provide for a greater cross-sectional area of the intermediate body section 146 compared to the cross-sectional area of the ribs 100, 101 of the intermediate body section 50 of the truss shoe 42, which increases the strength of the truss shoe 142 and permits the use of less overall material to construct the truss shoe 142, thus decreasing the weight of the truss shoe 142.

The cable engaging section 144 of the truss shoe 142 includes a flange 160 having an opening 162 for receiving and securing the portion of the cable 56 downstream of the cable securing arrangement 60 or 84. The opening 162 is positioned to secure the cable 56 horizontally in position. The opening 162 is sized and shaped to receive the body of the cable 56 therein. The flange 160 further includes a slot 164 leading into the opening 162. The slot 164 is preferably located along an axis running perpendicular from the base member 47. Having the slot 164 located along this axis permits easier installation of the cable 56 into the opening 162 because the slot 164 is in general alignment with the desired horizontal positioning of the cable 56. This positioning of the slot 164 also increases the overall strength of the flange 160 by providing equal flange wall portions on each side of the slot 164. The slot 164 includes a chamfered guiding area 166 leading into the opening 162. The guiding area 166 aids in the positioning of the cable 56 in the slot 164 during installation in instances when the cable 56 enters the slot 164 at an angle.

Figure 8:
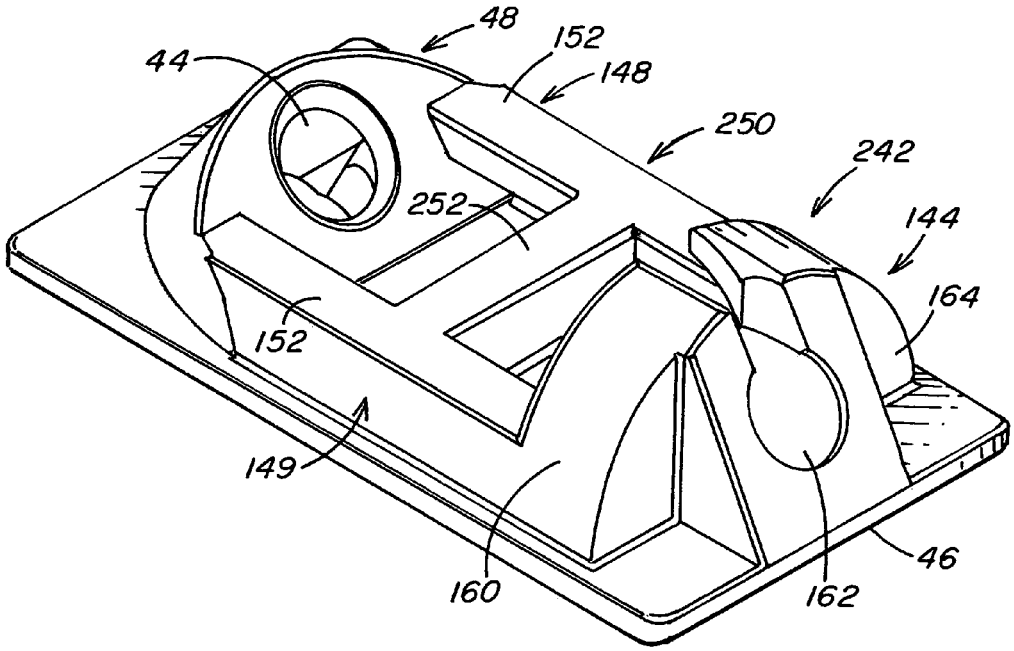
FIG. 8 is an orthogonal view of a third non-limiting embodiment of a truss shoe according to the invention.

FIG. 8 depicts a third non-limiting embodiment of a truss shoe of the invention designated by the number 242, which includes the base member 47, the cable engaging section 144, the bolt receiving section 48, and an intermediate body section 250 between and connected to each of the bolt receiving section 48 and the cable engaging section 144. The intermediate body portion 250 includes a rib 252 extending substantially perpendicular from the base member 47 between the pair of side flanges 148 and 149 and intersects each one of the lips 152 (also see FIG. 7). Preferably, the rib 252 is located midway between the bolt receiving section 48 and the cable engaging section 144. The rib 252 provides additional strength across a middle portion of the truss shoe 242, which is desirable when the truss shoe 242 is installed on an uneven surface. The additional strength aids in preventing buckling failures in these situations. In addition, the rib 252 assists in supporting the end 58 of the cable 56 (see FIGS. 5 and 6) after the cable 56 is mounted in the opening 162 of the cable retaining section 144 and provides a stop for preventing positioning of the cable securing arrangement 60 and 84 too far within the intermediate body section 250, e.g., center area of the truss shoe 242 between the side flanges 148 and 149, and between the opening 162 of the cable engaging section 144 and the bore 44 of the bolt receiving section 48 of the truss shoe 242. This aids in the ease of installation of the cable 56 in the cable engaging section 144 of the truss shoe 242 by maintaining the collar 62 and the washer 76 of the cable securing arrangement 60 and the cable securing arrangement 84 in a relatively horizontal position ready for seating in the slot 164 by preventing the end portion 58 of the cable 56 from overshooting horizontally and entering the center area of the intermediate body section 250 and by maintaining the cable 56 in an easily accessible position.

Figure 9:
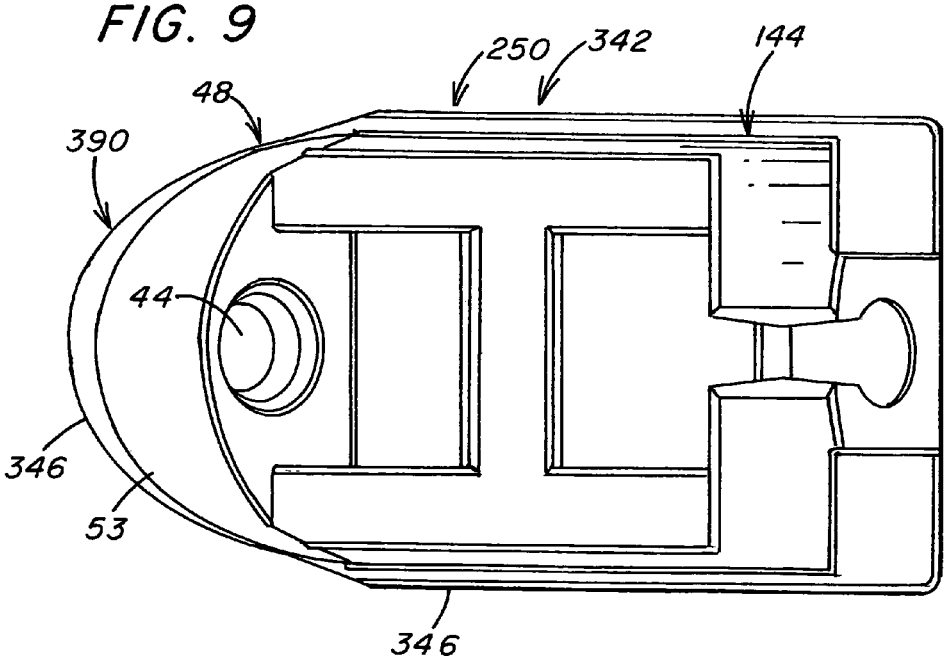
FIG. 9 is a top view of a fourth non-limiting embodiment of a truss shoe according to the present invention.

FIG. 9 depicts a fourth non-limiting embodiment of a truss shoe of the invention designated by the number 342, which includes a base member 346, the bolt receiving section 48 (see also FIGS. 2 and 3), the intermediate body section 250 (see also FIG. 8), and the cable engaging section 144 (see also FIG. 7). The base member 346 has a rounded end 390 at base of the housing 53 of the bolt receiving section 48 having the bore 44 and an opposite straight end adjacent the cable engaging section 144. The rounded end 390 generally follows the outer surface of the housing 53 at the base member 346. Specifically, the base member of this embodiment is coextensive with the area surrounding the housing 53 having the bore 44. Therefore, there is no area of the base member that extends further from the area surrounding a housing 53, which provides even further weight reduction, as discussed above. During installation of the roof bolt 27 or the roof bolt assembly 30 through the bore 44, the weight of the truss shoe being installed tends to pull the cable retaining section of the truss shoe being installed away from the roof 12. The rounded end 390, unlike a straight end, permits the truss shoe 342 to rotate, as needed, along the roof 12 during installation of the roof bolt 27 or the roof bolt assembly 30. This "play" in the system makes installation of the roof bolt, the roof bolt assembly, and the cables 56 (see FIGS. 1, 5, and 6) an easier operation.

Figure 10:
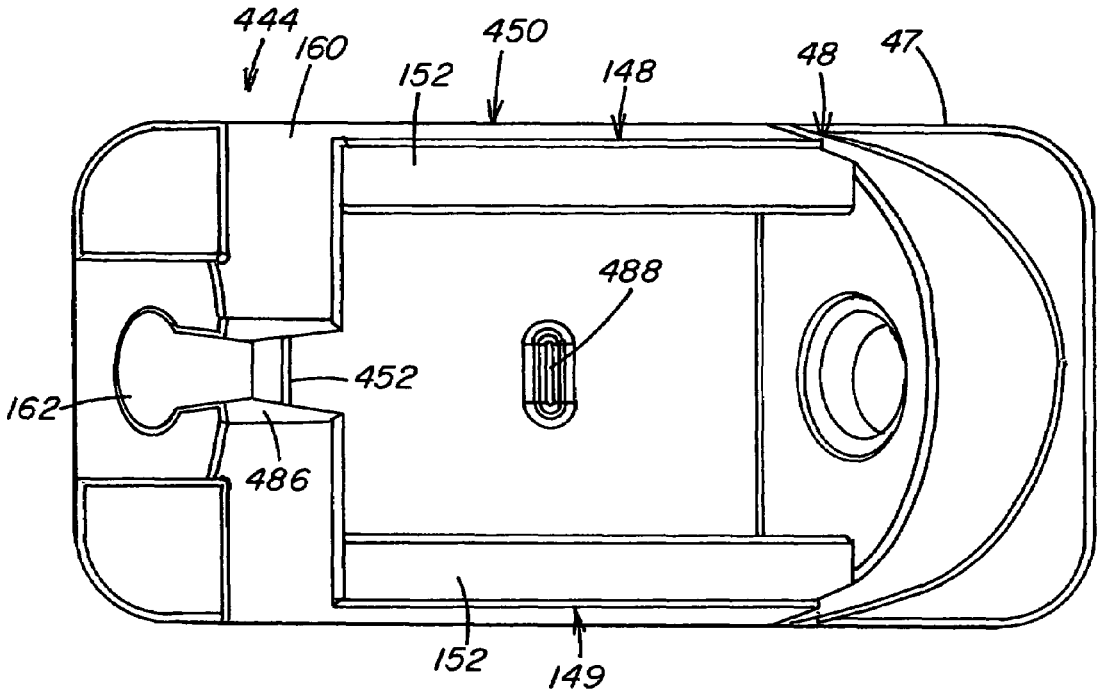
FIG. 10 is a top view of a fifth non-limiting embodiment of a truss shoe according to the present invention.

FIG. 10 depicts a fifth non-limiting embodiment of a truss shoe of the invention identified by the number 442, which includes the base member 47, the bolt receiving section 48, a cable engaging section 444, and an intermediate body section 450 between the bolt receiving section 48 and the cable engaging section 444. The cable engaging section 444 is similar to the cable engaging section 144 of the shoe 142 (FIG. 7) and includes the flange 160 having the opening 162, and a slot 452 similar to the slot 164 of the cable engaging section 144 of the shoe 142, except the slot 452 has a tapered guiding area 486 positioned on an end of the slot 452, i.e., the distance between the walls of the slot 452 decreases as the distance to the base member 47 increases. The guiding area 486 aids in the positioning of the cable 56 in the slot 452 during installation in instances when the cable 56 enters the slot 452 at an angle. The intermediate body section 450 of the truss shoe 442 includes the side flanges 148 and 149 (see FIG. 7) having the lips 152 and a rib 488. In preferred non-limiting embodiments of the invention, the rib 488 is positioned in a substantially central area midway between the side flanges 148 and 149 and/or midway between the bolt receiving section 48 and the cable engaging section 444. The rib 488 provides additional strength to the middle portion of the truss shoe 442, which is desirable when the truss shoe 442 is installed on an uneven surface; in these instances, the rib 488 prevents buckling failures of the truss shoe. Further, the rib 488 provides an additional support surface for the cable 56.

Figure 11:
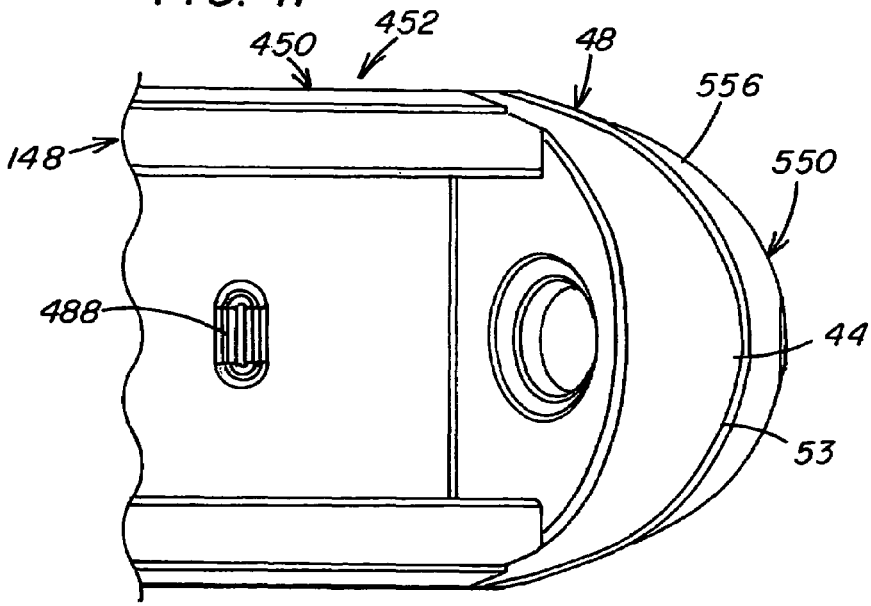
FIG. 11 is a top view of an end portion of sixth non-limiting embodiment of a truss shoe according to the present invention.

FIG. 11 depicts a sixth non-limiting embodiment of a truss shoe of the invention designated by the number 542. The truss shoe 542 includes a base member 550, a cable engaging section (not shown in FIG. 11), e.g., the cable engaging section 49 of the truss shoe 42 (see FIGS. 2 and 3), the cable engaging section 144 of the truss shoe 142 (see FIG. 7) or the cable engaging section 444 of the truss shoe 442 (see FIG. 10), the intermediate body section 450 having the side flanges 148 and 149, and the rib 488 (see FIG. 10), and the bolt receiving section 48. The base member 550 adjacent the bolt receiving section 48 is rounded to match the shape of the housing 53 having the bore 44. Optionally, the base 550 extends outward from the interface of the housing 53 and the base 550 to provide a rimed area 556 surrounding the housing 53 as shown in FIG. 11. The end of the base member 550 opposite to the end having the rimed area 556 (not shown) and the cable engaging section (not shown) can be but is not limited to any of the types previously discussed, to be discussed, and illustrated in the figures of the drawings. The base member 550 serves to reduce the weight of the truss shoe 542, which represents an added benefit to the truss shoe 542 with respect to the rest of the system.

Figure 12:
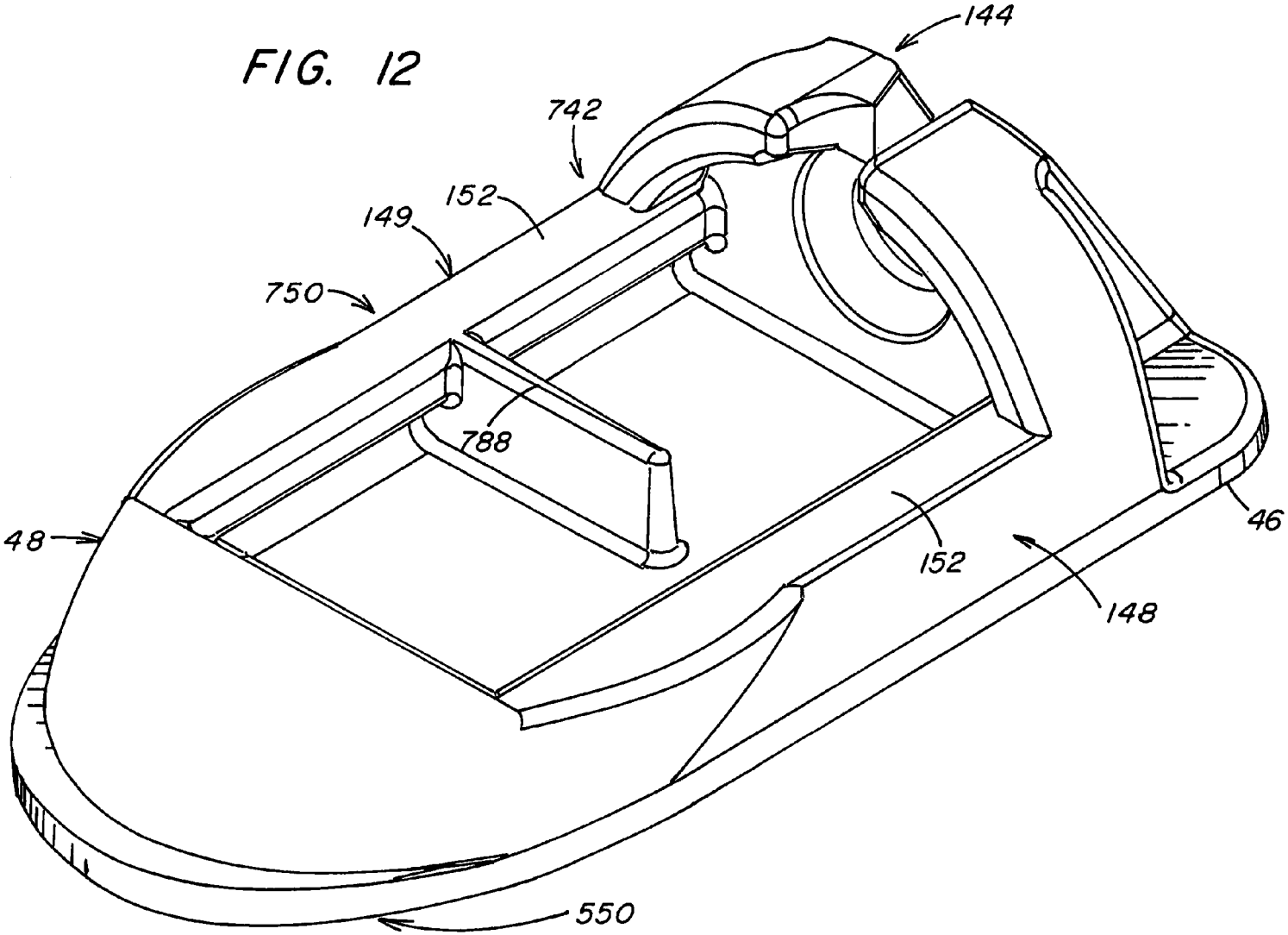
FIG. 12 is a perspective view of a seventh non-limiting embodiment of a truss shoe according to the present invention.

FIG. 12 depicts a seventh non-limiting embodiment of a truss shoe of the invention designated by the number 742. The truss shoe 742 includes the base member 550 (see FIG. 11), the bolt receiving section 48, the cable engaging section 144, and an intermediate body section 750. The intermediate body section 750 includes the side flanges 148 and 149 having the lips 152 (see FIG. 7) on the base member 550 and a rib 788 extending from the base member 550 as well as at least one of the ribs, e.g., the lip 152 of the side flange 149. The rib 788 may include tapered or rounded edges in order to prevent detrimental and frictional contact between the cable 56 and the truss shoe 742. In addition, the rib 788 is formed integrally with the lip 152 of the side flange 149 and, hence, is connected thereto, unlike the freestanding rib 488 of the truss shoe 442 shown in FIGS. 10 and 11. The rib 788 provides additional strength across a middle portion of the truss shoe 742, which helps to prevent buckling failures and assists in supporting the cable 56 in use.

Figure 13:
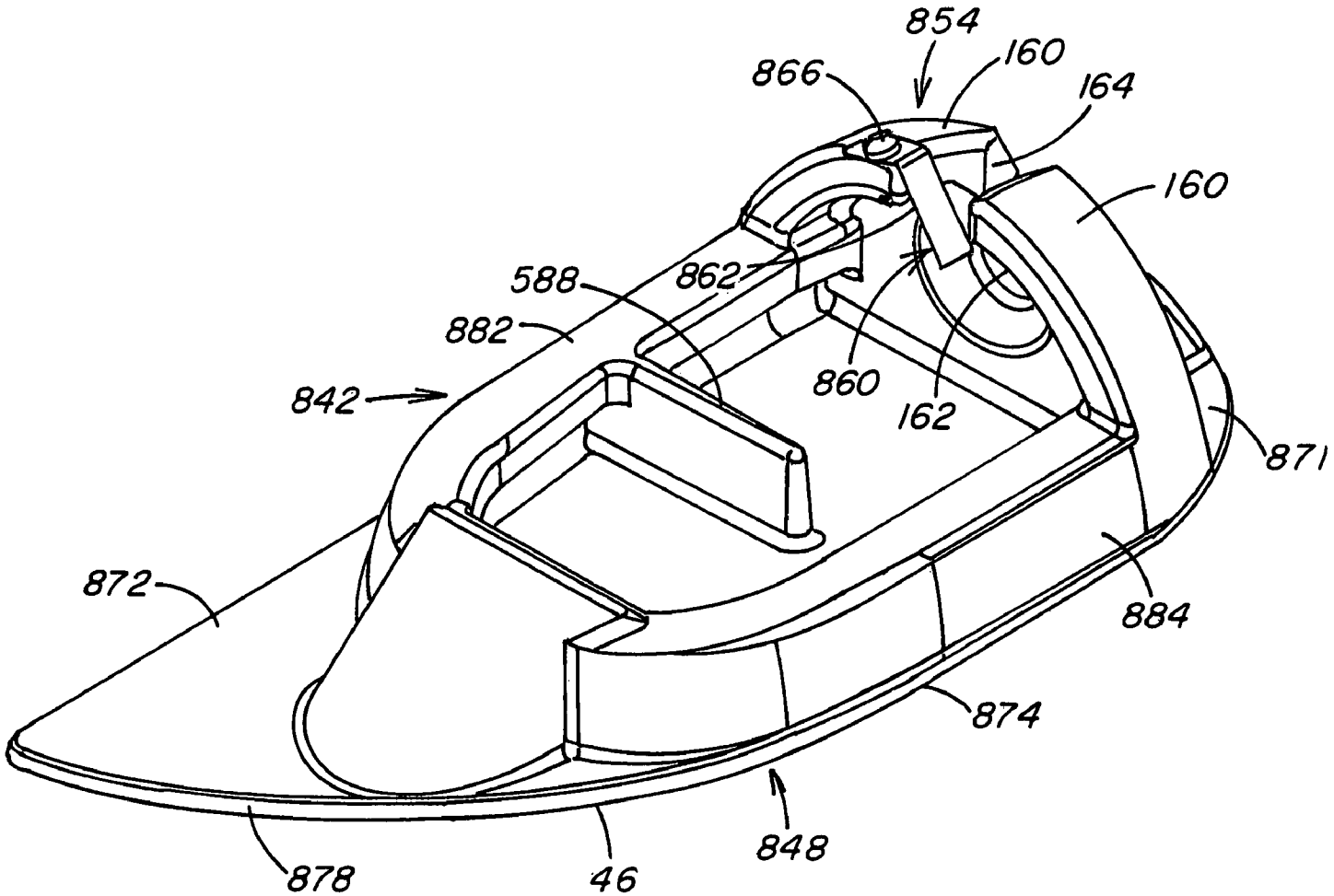
FIG. 13 is a perspective view of an eighth non-limiting embodiment of a truss shoe according to the present invention.
Figure 14:
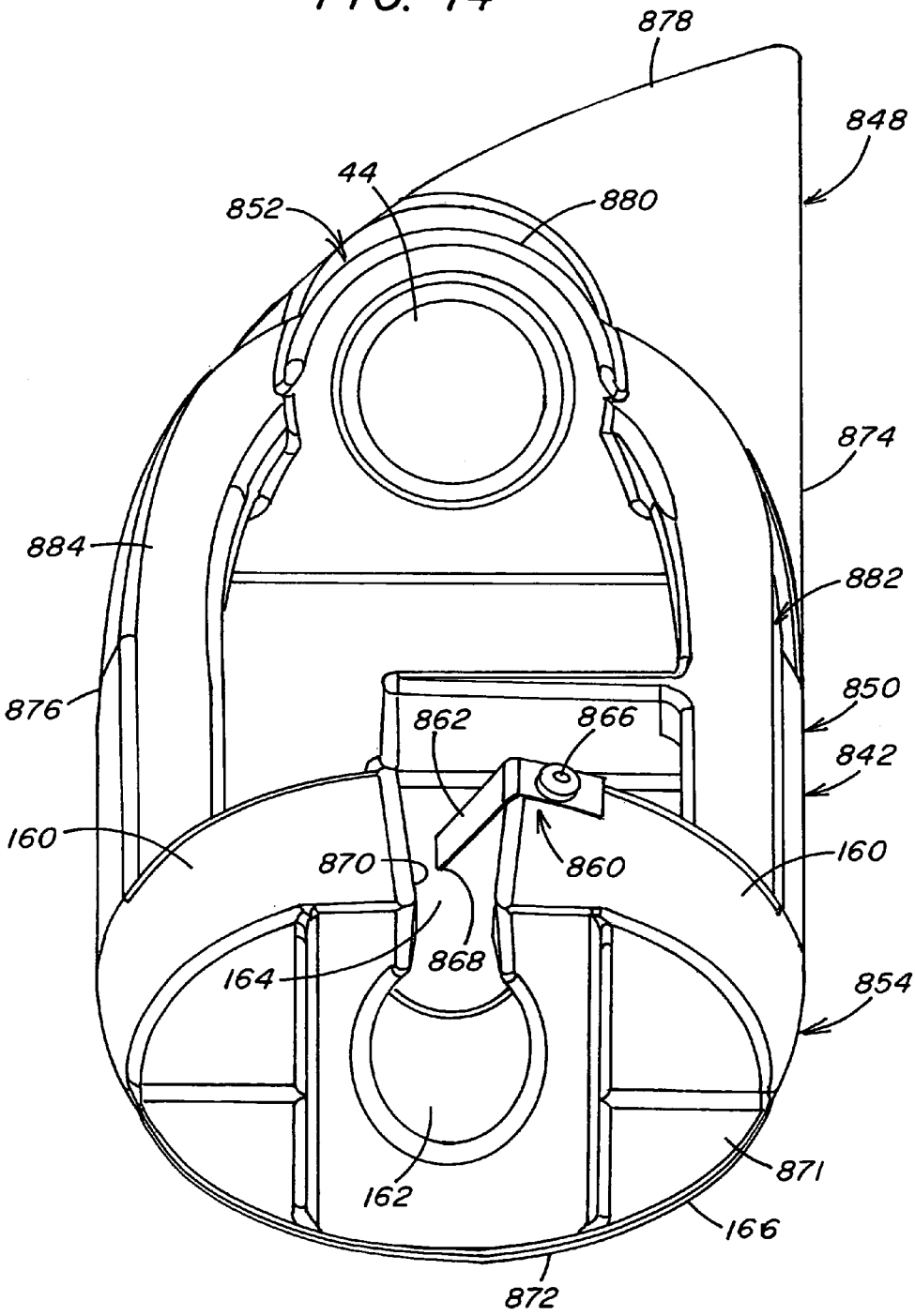
FIG. 14 is top elevational view seen from an end of the truss shoe shown in FIG. 13.
Figure 15:
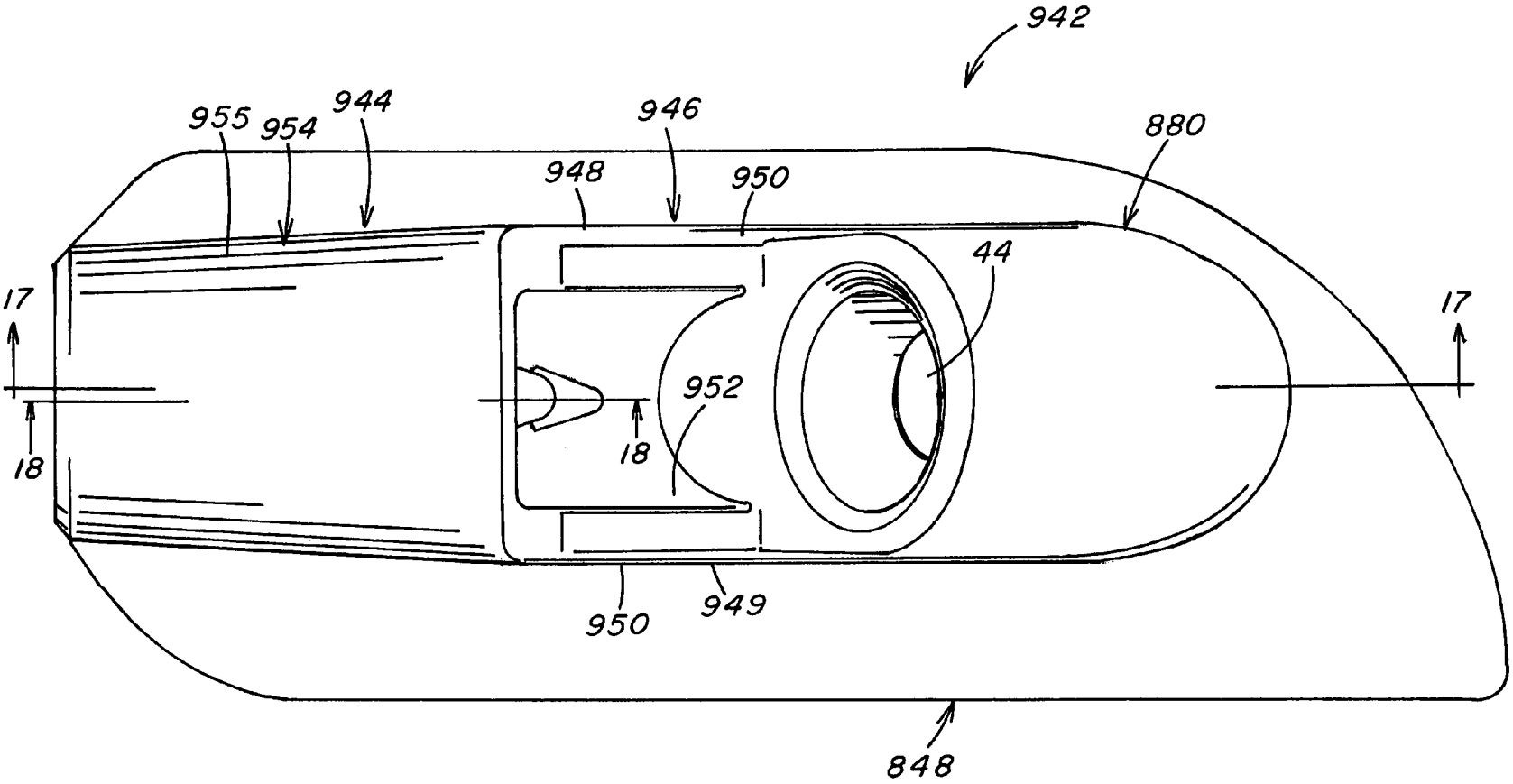
FIG. 15 is a top view of a ninth non-limiting embodiment of a truss shoe according to the present invention.

FIGS. 13 and 14 depict an eighth non-limiting embodiment of a truss shoe of the invention designated by the number 842. The truss shoe 842 includes a base member 848, an intermediate body section 850, a bolt receiving section 852, and a cable engaging section 854. The cable engaging section 854 includes the flange 160 having the opening 162 and the slot 164 leading into the opening 162. The slot 164 includes the chamfered guiding area 166. The guiding area 166 (clearly shown in FIG. 14) as discussed earlier aids in the positioning of the cable 56 in the slot 164 during installation in instances when the cable 56 enters the slot 164 at an angle, and the slot 164 is preferably located along an axis running perpendicular from the base member 848. Having the slot 164 located along this axis permits easier installation of the cable 56 in the opening 162, since the slot 164 is in general alignment with the desired horizontal positioning of the cable 56. This positioning of the slot 164 also increases the overall strength of the flange 160.

The cable engaging section 854 further includes a lock-in device 860 positioned in the slot 164 that permits movement of the cable 56 through the slot 164 into the opening 162 and retains the cable 56 in the opening 162. The lock-in device 860 includes a flexible strip or strip member 862 having one end portion 864 secured at 866 to outer surface of the flange 160 in any convenient manner, e.g., by a rivet or screw, and another end portion 868 extending into the slot 164 toward a surface 870 of the slot 164. The length and slope, e.g., the angle, of the strip 862 in the slot 164 with respect to the surface 870 of the slot 164 is not limiting to the invention. In the practice of the invention, it is preferred but not limited thereto that the strip 862 has a length and slope such that the end 868 of the strip 862 terminates short of, or just touches, the surface 870 of the slot 164 and has minimal, if any, extension into the opening 162 when the strip 862 is in the unbiased or initial position. With this arrangement, the cable 56 is moved into the slot 164 into engagement with the strip 862 to bias the strip, e.g., move the strip, from the initial or unbiased position toward the opening 162. Continued movement of the cable 56 through the slot 164 toward the opening 162 moves the cable into the opening 162 past the end 868 of the strip 862, allowing the end 868 of the strip 862 to move to its unbiased or initial position, capturing the cable in the opening 162. In the preferred practice of the invention, the length of the strip portion in slot 164 is greater than the width of the slot 164 i.e., greater than the distance between opposed surfaces 870 and 871 of the slot 164. In this manner, the cable 56 is captured in the opening 162 and/or the slot 164. More particularly, with the truss shoe 842 bolted to the roof 12 of the passageway 14 (see FIG. 1), and before the cable is put under tension, the cable in opening 162 moves under the force of gravity into the slot 164 and engages the strip 862, moving the end 868 of the strip 862 against the surface 870 of the slot 162. The length of the strip 862 in the slot is greater than the distance between the surfaces 870 and 871 of the slot 164 preventing the strip 862 from freely moving out of the slot, thereby capturing the cable 56 in the opening 162 and/or slot 164.

The invention is not limited to the material of the flexible strip 862, e.g., the strip can be made of plastic, fiberglass-reinforced plastic, or metal, e.g., spring steel, and/or is not limited to the physical dimensions of the strap, however, in the practice of the invention but not limited thereto, the strap should be sufficiently short to permit moving the cable 56 through the slot 164 into the opening 162, and sufficiently long to resist movement of the cable 56 out of the opening 162 as previously discussed.

With reference to FIGS. 13 and 14 as needed, end 872 of the base member 848 adjacent the cable engaging section 854 is rounded for ease of moving the truss shoe about the roof bolt assembly 30 (see FIG. 1), e.g., not engaging the roof 12 of the passageway 14 when the roof has a slope toward the floor 26. The base member 848 has one side, e.g., side 874, longer than opposite side, e.g., opposite side 876, to provide end 878 of the base member 848 adjacent the bolt receiving section 852 with an arcuate edge or a sweeping radius as clearly shown in FIGS. 13 and 14. The sweeping radius at the end 878 and the rounded end 872 assist in moving the truss shoe 842 into the installation position.

The bolt receiving section 852 includes a housing 880 having the bore 44. The outer surface area of the housing 880 of the bolt receiving section 852 is smaller than the outer surface area of the housing 53 of the bolt receiving section 48 (see FIG. 3) to reduce the weight of the shoe. In one preferred embodiment of the invention, the distance between the outer surface of the housing 880 and the inner wall of the bore 44 is ½ inch (1.27 centimeters).

The intermediate body section 850 of the shoe 842 includes side flanges 882 and 884 and the rib 788 (see FIG. 12). The side members 882 and 884 are similar in cross section as the side flanges 148 and 149 (see FIG. 7); however, unlike the flanges 148 and 149 which are straight, the side flanges 882 and 884 are straight as they extend from the cable engaging section 854 toward the bolt receiving section 852 and as the side flanges 882 and 884 approach the bolt receiving section, the side flanges each curve toward the housing 880 of the bolt receiving section 852. The side flanges 882 and 884, as they approach the housing 880, curve for a smooth transition into the outer surface of the housing 880 of bolt receiving section 852.

Figures 16, 16A, 16B:
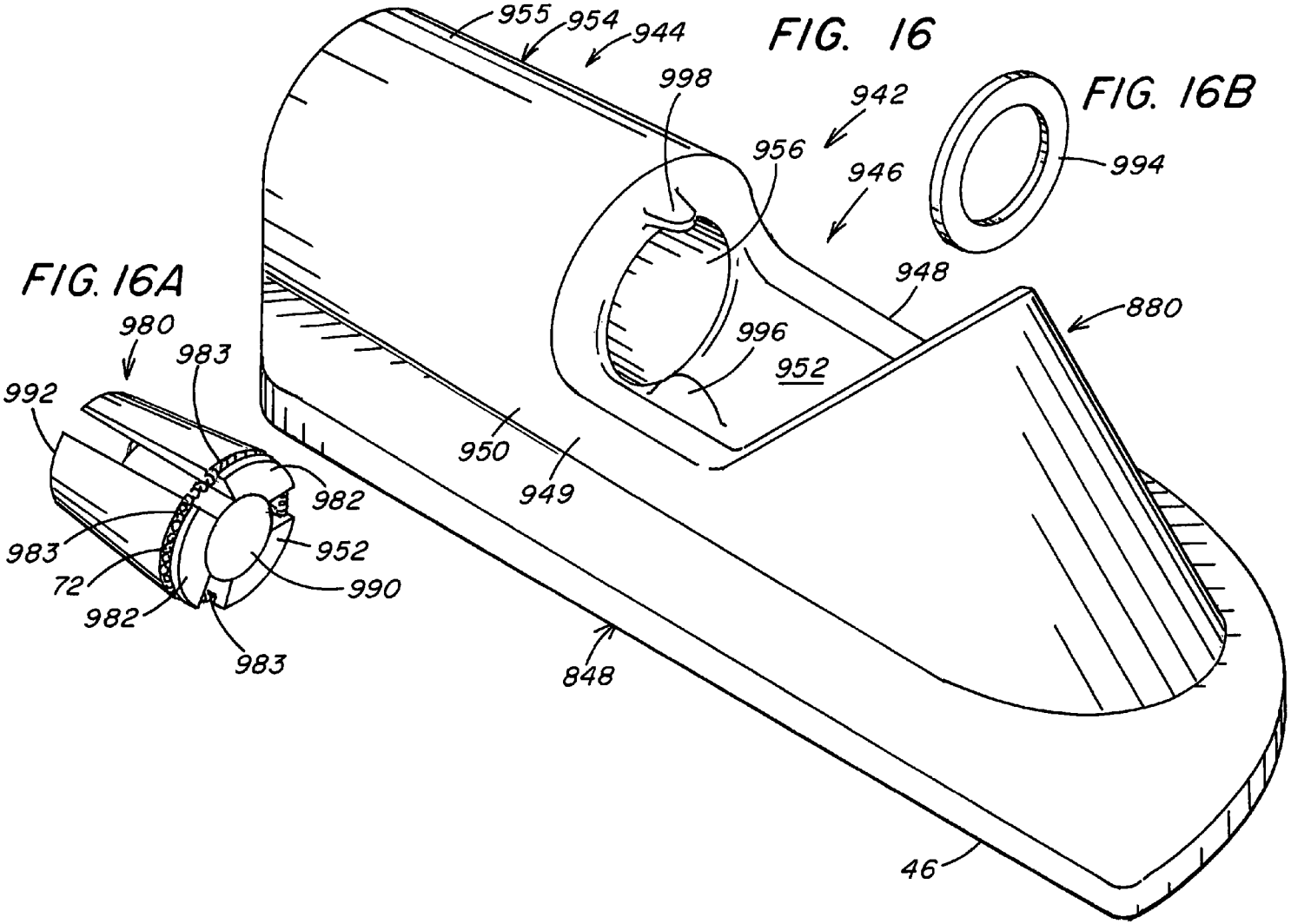
FIG. 16 is an orthogonal view of the truss shoe of FIG. 15.
FIGS. 16A and 16B are orthogonal views of components used to retain a cable in the truss shoe of FIG. 15.
Figure 17:
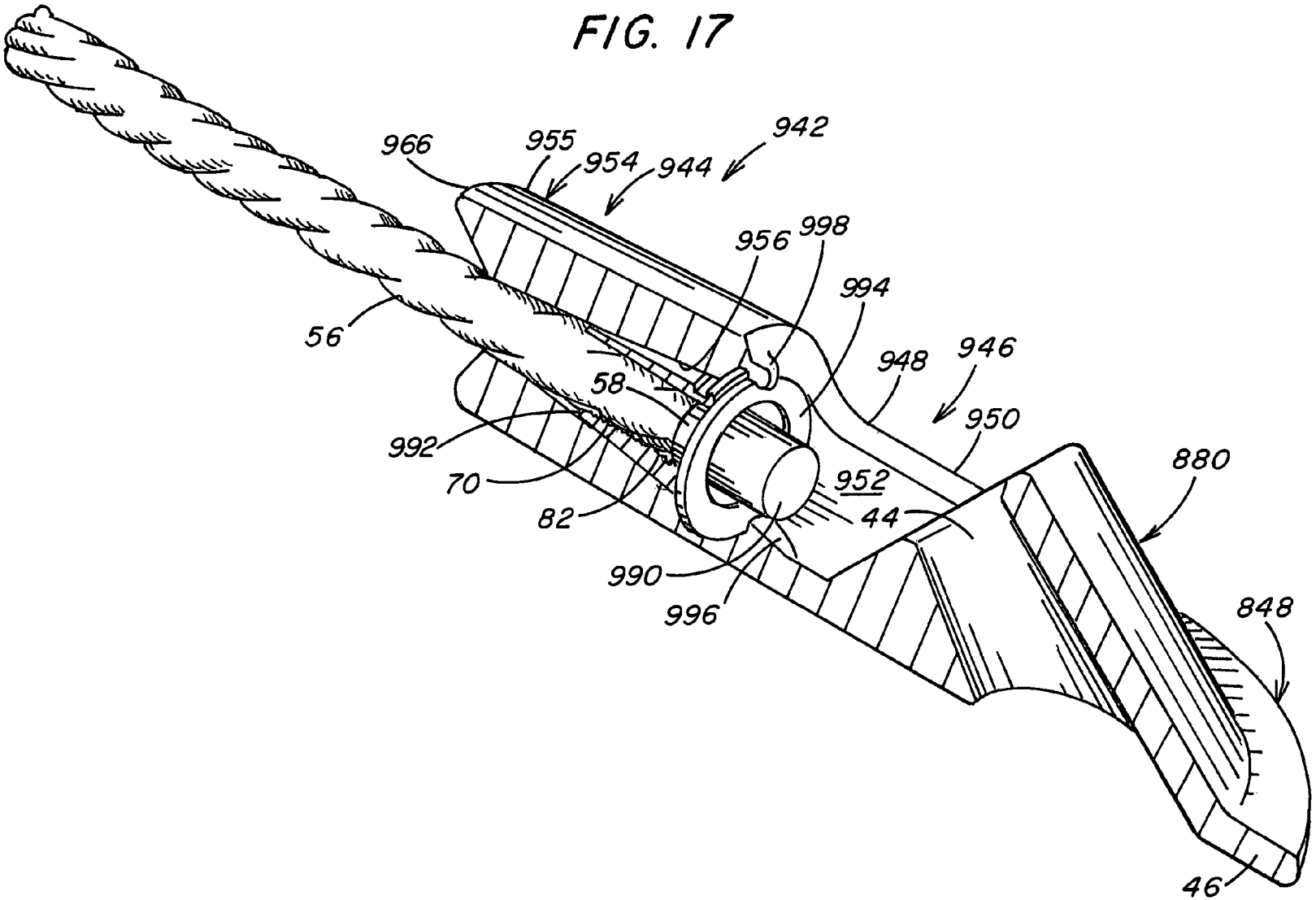
FIG. 17 is a cross-sectional view of the truss shoe taken along lines 17-17 shown in FIG. 15 having the cable retention component shown in FIGS. 16A and 16B mounted in the shoe about a cable.
Figure 18:
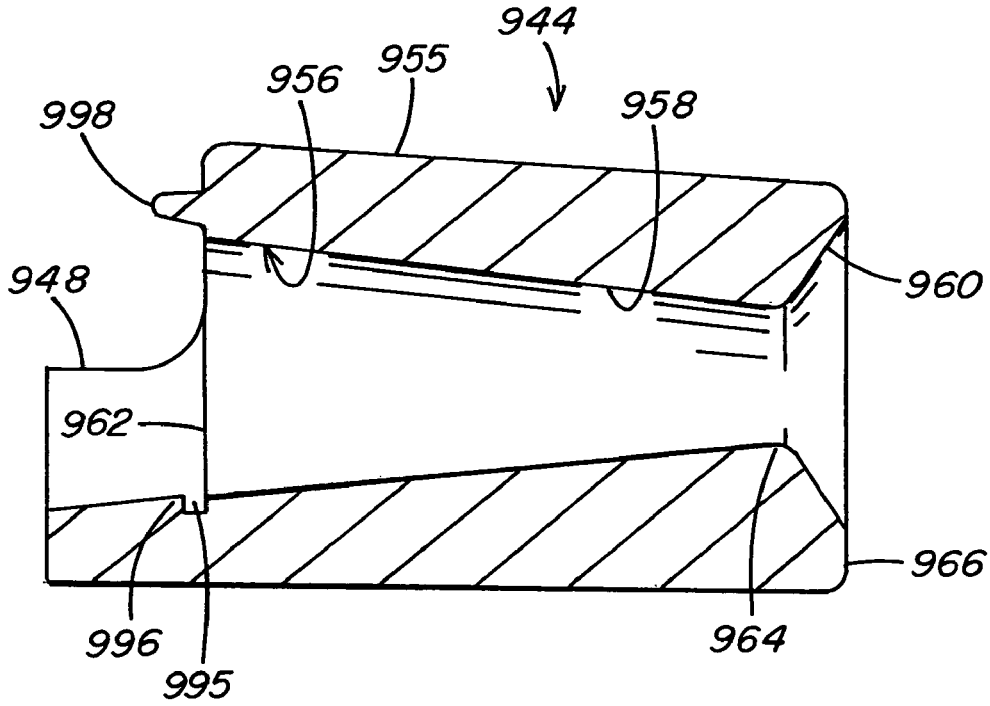
FIG. 18 is a view taken along lines 18-18 of FIG. 15.

With reference to FIGS. 15-18, there is shown a ninth non-limiting embodiment of the invention of a truss shoe of the invention designated by the number 942. The truss shoe 942 includes the base member 848 having the bearing surface 46 (see FIGS. 15 and 16), the bolt receiving section 852 having the bore 44, a cable engaging section 944 extending upwardly or outwardly from the base member 848 in spaced relation to the bolt receiving section 852, and an intermediate body section 946 extending from the bolt receiving section 852 to the cable engaging section 944. The intermediate body section 946 includes a pair of side ribs 948 and 949 extending from the bolt receiving section 852 to the cable engaging section 944. Each side rib 948, 949 extends upwardly or outwardly from the base member 848 and has a rounded outer surface 950, a rounded inner surface 952, and in one non-limiting embodiment of the invention has a wall thickness at the farthest distance from the base member 848 of ⅝ inch (1.59 centimeters) which thickness increases as the distance to the base member 848 decreases. The cable engaging section 944 includes a housing 954 extending upwardly or outwardly from the base member 848, the housing 954 has a rounded outer surface 955 and a passageway 956 extending through the housing 954 (see FIGS. 16 and 17). With reference to FIG. 18, the passageway 956 has a first cone-shaped portion 958 and a second cone-shaped portion 960. The first cone-shaped portion 958 has a decreasing diameter as the distance from side 962 of the housing 954 increases to a transition point 964 at which the second cone-shaped portion 960 begins and the diameter of the second cone-shaped portion increases as the distance from the side 962 of the housing 954 increases, or as the distance from side 966 of the housing 954 decreases. The second cone-shaped portion 960 has the larger diameter at the side 966 of the housing 954 for ease of moving the cable end 58 into the passageway 956. The first cone-shaped portion 958 of the passageway 956 is shaped to receive and retain cable retaining assembly 980, which is similar to the cable retaining assembly 68 shown in FIGS. 5 and 6. The cable retaining assembly 980 includes a plurality of discrete segments, three discrete segments 982 shown in FIG. 16A held together by the spring band 72 in groove 983 in each of the segments 982 adjacent to their larger end. The spring band 72 holds the segments 982 together for ease of inserting the cable retaining assembly 980 into the first cone-shaped portion 958 of the passageway 956. As is appreciated, the cable retaining assembly 980 without the spring band 72 holding the ends together can be used in the practice of the invention. With the segments 982 held together and in the first cone-shaped section 958 of the passageway 956 as shown in FIG. 17, the cable retaining assembly 980 has the circular passageway 70 having the teeth 82 (see also FIG. 5) to retain the cable in the passageway 70 of the cable retaining assembly 980 as previously discussed for the cable retaining assembly 68 (see FIG. 5). For ease of moving the cable 56 into the cable retaining assembly 980, an expander 990 is positioned in the passageway 70 of the assembly 980.

As can be appreciated, the diameter of the transition point 964 is equal to or less than the outside diameter of end 992 of the cable retaining assembly 980 (see FIGS. 16A and 17), e.g. in a non-limiting embodiment of the invention, the diameter of the transition point 964 in the passageway 956 (see FIG. 18) is 0.70 inch (1.75 centimeters) and the diameter of the end 992 of the cable retaining assembly 980 with the segments 982 (see FIG. 16A) held together is 0.81 inch (2.1 centimeters). The diameter of the expander 990 of the cable retaining assembly 980 is 0.75 inch (1.9 centimeters) (see FIG. 16A) for a cable diameter of 0.60 inch (1.5 centimeters). In one non-limiting embodiment of the invention, the length of the cable retaining assembly 980 is 1.6 inches (4.1 centimeters); the length of the first cone-shaped section 958 of the passageway 956 is 3 inches (7.6 centimeters); and the diameter of the passageway 956 at the side 962 is 1.4 inches (3.6 centimeters).

In the preferred practice of the invention, the truss shoe 942 is assembled by placing the spring band 72 in the groove 983 of each of the segments 982 to hold the segments together. The expander 990 is moved through the end 992 of the assembly 980 into the passageway 70 of the assembly 980. The end 992 of the cable retaining assembly 980 is moved into through the side 962 of the housing 954 into the passageway 956 (see FIG. 18). With reference to FIG. 16B bottom portion of washer 994 is placed in a groove 995 formed by rib 996 and the side 962 of the housing 954 (clearly shown in FIG. 17), and the upper portion of the washer 994 is moved against the side 962 held against the side 962 by bending tab 998 provided on the side 962 of the housing 954 over the upper portion of the washer 994. As can be appreciated, the hole of the washer 994 has an inside diameter greater than the diameter of the expander 990 and an outside diameter greater than the diameter of the first cone-shaped portion 958 at the side 962 of the housing 954.

In one non-limiting embodiment of the invention, the truss shoe is fabricated at a facility and shipped to the underground passageway 14 (see FIG. 1). The bolt receiving section 852 of the truss shoe 942 is bolted to the roof of the underground passageway 14 as previously discussed. With reference to FIGS. 16 and 17, the end 58 of the cable 56 is moved into the second cone-shaped portion 960 of the passageway 956 at the side 966 of the housing 954 against the expander 990. Continued movement of the cable 56 into the passageway 70 of the cable retaining assembly 980 moves the expander 990 out of the passageway 70 of the cable retaining assembly 980 and through the hole of the washer 994. Thereafter, the expander 990 drops out from between the ribs 948 and 949 of the intermediate body section 946 onto the floor 26 below the truss shoe 942.

The washer 994 retains the cable retaining assembly 980 in the passageway 956 of the housing 954 of the cable engaging section 944. After the cable end 58 has moved through the washer 994, the cable 56 is pulled away from the truss shoe 942 away from the side 966 of the housing 954 to move the cable retaining assembly 980 further into the first cone-shaped portion 958 of the passageway 956 in the housing 954 toward the transition point 964 to move the segments 982 against the portion of the cable 56 in the cable retaining assembly 980 to secure the cable 56 in the cable engaging section 944 of the truss shoe 942.

As can be appreciated, the invention contemplates interchanging the various non-limiting embodiments of the base members, the cable engaging sections, the bolt receiving sections and intermediate body sections with one another to provide additional non-limiting embodiments of truss shoes of the invention. For example and not limiting the invention thereto, the base 47 of the truss shoe 42 (FIG. 2) and the base member 848 of the truss shoe 842 (FIG. 13) can be interchanged; the housing 53 of the bolt receiving section 48 of the truss shoe 342 (FIG. 9) and the housing 880 of the bolt receiving section 880 of the truss shoe 842 (FIG. 15) and the cable engaging section 144 of the truss shoe 42 (FIG. 2) can be interchanged.

It will be understood by those skilled in the art that while the foregoing description set forth in the detailed non-limiting preferred embodiments of the present invention, modifications, additions, and changes can be made thereto without departing from the spirit and scope of the invention.

The invention claimed is:

1. A truss shoe for use in a mine roof support system, comprising:

a base member comprising a bearing surface for engaging a mine roof;

a body extending from the base member, the body comprising:

a bolt receiving section comprising a bore extending through the bolt receiving section and the base member;

a cable engaging section spaced from the bolt receiving section and having an opening therethrough to receive a portion of a cable; and an intermediate section between the bolt receiving section and the cable engaging section, the intermediate section comprising a pair of ribs extending away from the base member and extending between and connected to the bolt receiving section and the cable engaging section, wherein the pair of ribs is selected from the group of (1) each of the pair of ribs has a lip portion, the lip portion of the pair of ribs faces one another and each lip portion provides its respective rib with a recess, the recess extending from the lip to the base member; (2) an elongated member extending between and connected to each of the pair of ribs and spaced from the bolt receiving section and the cable engaging section; (3) a third rib extending upward from the base member, the third rib member between and spaced from the pair of ribs and between and spaced from the bolt receiving section and the cable engaging section; and (4) an elongated member extending upward from the base member, between each of the pair of ribs, connected to one of the ribs and spaced from the other one of the ribs, and between and spaced from the bolt receiving section and the cable engaging section.

2. A truss shoe for use in a mine roof support system, comprising:

a one-piece body member, comprising:

a base member comprising a bearing surface for engaging a mine roof;

a body extending from the base member, the body comprising;

a bolt receiving section comprising a bore extending through the bolt receiving section and the base member;

a cable engaging section spaced from the bolt receiving section and having an opening therethrough to receive a portion of a cable, wherein the opening of the cable engaging section comprises a flange configured to receive body portion of a cable therein, and a chamfered receiving area configured to receive end portion of a cable retaining collar, the flange comprises a circular cavity having a first open end facing the bolt receiving section and a second opposite open end, and a pair of spaced walls providing an access opening to move a portion of a cable between the spaced walls into the cavity, and the first end of the cavity having the chamfered receiving area configured to receive end portion of a cable retaining collar;

a flexible elongated member having one end secured to one of the walls of the access opening and angled to extend into the access opening, the length of the elongated member sufficient to engage the other one of the walls of the access opening, and an intermediate section between the bolt receiving section and the cable engaging section.

3. A truss shoe for use in a mine roof support system, comprising:

a one-piece body member, comprising:

a base member comprising a bearing surface for engaging a mine roof, a body extending from the base member, the body comprising;

a bolt receiving section comprising a bore extending through the bolt receiving section and the base member;

a cable engaging section spaced from the bolt receiving section and having an opening therethrough to receive a portion of a cable wherein surface of the bolt receiving section facing away from the cable engaging section is a curved surface, with one end of the curved surface at one side of the base member and the other end of the curved surface at opposite side of the base member, end of the base member adjacent the bolt receiving section and between the opposed sides of the base member is curved and spaced from the curved surface of the bolt receiving section;

a flexible elongated member having one end secured to one side of the opening of the cable engaging section and extending over the opening, and an intermediate section between the bolt receiving section and the cable engaging section.

4. A truss shoe for use in a mine roof support system, comprising:

a one-piece body member, comprising:

a base member comprising a bearing surface for engaging a mine roof;

a body extending from the base member, the body comprising;

a bolt receiving section comprising a bore extending through the bolt receiving section and the base member;

a cable engaging section spaced from the bolt receiving section and having an opening therethrough to receive a portion of a cable, wherein surface of the bolt receiving section facing away from the cable engaging section is a curved surface, with one end of the curved surface at one side of the base member and the other end of the curved surface at opposite side of the base member, end of the base member adjacent the bolt receiving section and between the opposed sides of the base member is curved and the curved surface of the bolt retention end portion extends to the curved side of the base member;

a flexible elongated member having one end secured to one side of the opening of the cable engaging section and extending over the opening, and an intermediate section between the bolt receiving section and the cable engaging section.

5. A truss shoe, for use in a mine roof support system, comprising:

a one-piece body member, comprising:

a base member comprising a bearing surface for engaging a mine roof;

a body extending from the base member, the body comprising:

a bolt receiving section comprising a bore extending through the bolt receiving section and the base member, wherein the bore of the bolt receiving section has a first end opening at the bearing surface and an opposite second end opening, the second end opening of the bore is circular and has a decreasing radius from the second end opening of the bore to a position within the bore spaced a predetermined distance from the second opening of the bore; a wall portion of the bore of the bolt receiving section lies on a line extending from the first end of the bore to the second end of the bore defined as a first line, wherein the first line and a plane containing the bearing surface subtend an angle of 45°; a wall portion of the bore of the bolt retention end portion lies on a line extending from the first end of the bore to the second end of the bore defined as a second line, wherein the first line and the second line are opposite one another, and the second line and a line normal to a third plane containing the bearing surface subtend an angle less than 45° to provide a non-circular first opening and the circular second openings;

a cable engaging section spaced from the bolt receiving section and having an opening therethrough to receive a portion of a cable, wherein the opening of the cable engaging section comprises a flange configured to receive body portion of a cable therein, and a chamfered receiving area configured to receive end portion of a cable retaining collar, the flange comprises a circular cavity having a first open end facing the bolt receiving section and a second opposite open end, and a pair of spaced walls providing an access opening to move a portion of a cable between the spaced walls into the cavity, and the first end of the cavity having the chamfered receiving area; center line extending through the first and second ends of the cavity is generally parallel to the third plane containing the bearing surface; a fourth plane between and equally spaced from the walls of the access opening is normal to the third plane containing the bearing surface; further comprising a flexible elongated member having one end secured to one of the sides of the access opening and angled to extend into the access opening toward the other one of the sides of the access opening;

an intermediate section between the bolt receiving section and the cable engaging section, wherein the intermediate body section comprises a rib adjacent each of the first and second sides of the base member and each rib extends from the cable engaging section to the bolt receiving section, and wherein the base member has a pair of parallel sides defined as a first side and a second side, with the first side longer than the second side and extending beyond the bolt receiving section a greater distance than the second side, a curved side between the first and second sides adjacent the cable engaging section and a curved side adjacent the bolt receiving section.

6. A truss shoe for use in a mine roof support system, comprising:

a one-piece body member, comprising:

a base member comprising a bearing surface for engaging a mine roof;

a body extending from the base member, the body comprising;

a bolt receiving section comprising a bore extending through the bolt receiving section and the base member;

a cable engaging section spaced from the bolt receiving section and having an opening therethrough to receive a portion of a cable;

a cable in the opening of the cable engaging section and extending toward the bolt receiving section, a cone-shaped retention member mounting portions of the cable between the cable engaging section and the bolt receiving section, the cone-shaped retention member comprising at least two pieces held together by a flexible band, the at least two pieces mounted in a cone-shaped passage of a collar, wherein as the at least two pieces move into the passageway of the collar, the at least two pieces are urged toward the cable between the at least two pieces, and an intermediate section between the bolt receiving section and the cable engaging section.

7. The truss shoe according to claim 6, wherein the bore of the bolt receiving section has a first end opening at the bearing surface that is non-circular and an opposite second end opening that is circular.

8. The truss shoe according to claim 7, wherein (1) the second end opening of the bore of the bolt receiving section has a decreasing radius from the second end opening of the bore to a position within the bore spaced a predetermined distance from the second opening of the bore, and (2) a wall portion of the bore lies on a line extending from the first end of the bore to the second end of the bore defined as a first line, wherein the first line and a plane containing the bearing surface subtend a predetermined angle, and a wall portion of the bore lies on a line extending from the first end of the bore to the second end of the bore defined as a second line, wherein the first line and the second line are opposite one another, and the second line and a plane containing the bearing surface subtend an angle less than a predetermined angle.

9. A truss shoe for use in a mine roof support system, comprising:

a one-piece body member, comprising:

a base member comprising a bearing surface for engaging a mine roof;

a body extending from the base member, the body comprising;

a bolt receiving section comprising a bore extending through the bolt receiving section and the base member, wherein the bore of the bolt receiving section has a first end opening at the bearing surface that is non-circular and an opposite second end opening that is circular;

a cable engaging section spaced from the bolt receiving section and having an opening therethrough to receive a portion of a cable, wherein the opening is a passageway and the cable engaging section comprises a housing extending upward from the base member and having a first open end facing the bolt receiving section and an opposite second open end, with the passageway between the first end and the second end, the passageway having decreasing distance between wall portions as the distance from the first open end increases to provide a passageway having a predetermined interior surface configuration; a wedge assembly comprising at least two parts mounted in the passageway; an expander mounted in the wedge assembly and secured therein; and a retainer ring mounted in the retaining groove and secured over the first end opening, the retainer ring having an opening sized to retain the wedge assembly in the passageway while allowing the expander to pass therethrough; and an intermediate section between the bolt receiving section and the cable engaging section.

10. The truss shoe according to claim 9, wherein the intermediate section comprises a pair of ribs extending away from the base member and extending between and connected to the bolt receiving section and the cable engaging section.

11. The truss shoe according to claim 9, wherein the base member has a rectangular outer shape.

12. The truss shoe according to claim 11, wherein a portion of the cable engaging section extends to outer edge of one of the sides of the base member, and the bolt receiving section is spaced from edge of adjacent one of the base members.

13. The truss shoe according to claim 9, wherein the intermediate section comprises a pair of spaced ribs extending upward from the base member, spaced from one another and extending from the bolt receiving section to the cable engaging section, and a retaining groove between the spaced ribs adjacent the cable engaging section.

14. A truss shoe for use in a mine roof support system, comprising:

a base member comprising a bearing surface for engaging a mine roof;

a body extending from the base member, the body comprising:

a bolt receiving section comprising a bore extending through the bolt receiving section and the base member, wherein the bore of the bolt receiving section has a first end opening at the bearing surface that is non-circular and an opposite second end opening that is circular;

a cable engaging section spaced from the bolt receiving section and having a passageway therethrough to receive a portion of a cable, the cable engaging section comprises a housing extending upward from the base member and having a first open end facing the bolt receiving section and an opposite second open end, with the passageway between the first end and the second end, the passageway having a cone shape with diameter at the first open end decreasing as the distance from the first open end increases;

a wedge assembly having an outer cone shape and an inner circular passage, and comprises three actuate discrete segments secured together by a biasing band mounted in the passageway, the wedge assembly sized to fit within the first end opening of the cable receiving section, with larger end of the wedge assembly having a greater diameter than the second opening, a plurality of surface engaging members on inner surface of the wedge assembly and angled toward the larger end of the wedge assembly;

a tab adjacent the first end opening of the passageway having one end connected to the cable engaging section and the other end extending over a washer positioned over the first end opening of the passageway, the washer having an opening sized to retain the wedge assembly in the passageway while allowing an expander mounted in the wedge assembly and secured therein to pass therethrough; and an intermediate section between the bolt receiving section and the cable engaging section.

15. A truss shoe for use in a mine roof support system, comprising:

a one-piece body member, comprising:

a base member comprising a bearing surface for engaging the mine roof;

a body portion extending from the base member;

a bore extending at an angle through the body portion and the base member, the bore terminating at the bearing surface to provide a hole in the bearing surface and a smooth bearing surface wherein a straight line along interior wall of the bore and a plane containing the bearing surface subtend an acute angle;

a flange including an opening for receiving and securing an end portion of a cable therein, the opening including a slot configured to receive a body of the cable therein, and a chamfered receiving area configured to receive a spherical washer positioned near the end portion of the cable;

a flexible elongated member having one end secured to one wall of the opening and angled to extend into the opening, the length of the elongated member sufficient to engage opposite one of the walls of the opening.

16. A truss shoe for use in a mine roof support system, comprising:

a base member comprising a bearing surface for engaging the mine roof and an arcuate end;

a body portion extending from the base member;

a bore extending at an angle through the body portion and the base member, wherein the arcuate end of the base member is near the bore;

a flange comprising an opening for receiving and securing an end portion of a cable therein, the opening comprising a slot configured to receive a body of the cable therein, and a chamfered receiving area configured to receive a spherical washer positioned near the end portion of the cable;

a pair of side flanges extending substantially perpendicular from the base member between the bore and the flange, wherein each of the pair of side flanges terminates in a lip extending substantially perpendicular to the side flange; and a rib extending substantially perpendicular from the base member between the pair of side flanges.

17. A truss shoe for use in a mine roof support system, comprising:

a one-piece body member, comprising:

a base member comprising a bearing surface for engaging a mine roof, wherein the base member comprises a first major surface and an opposite second major surface, a first side and an opposite second side, with the first side longer than the second side, and a first end joining the first side and the second side, the first end having a curved peripheral surface and an opposite second end joining the first and the second sides, wherein the first major surface of the first end is larger than the second major surface of the second end, and peripheral edge of the first end is curved to provide a sweeping radius;

a body extending from the base member, the body comprising;

a bolt receiving section comprising a bore extending through the bolt receiving section and the base member;

a cable engaging section spaced from the bolt receiving section and having an opening therethrough to receive a portion of a cable, wherein the cable engaging section comprises a flange mounted on the first major surface adjacent to and spaced from the second side, the flange extending away from the first major surface and having an opening, and a slot extending away from the opening and the first major surface to outer surface of the flange and the bore of the bolt receiving section is spaced from the first side and the flange, the bore extending at an angle through the first and second surfaces of the base;

a flexible elongated member having one end secured to one wall of the opening and extends toward opposite one of the walls of the opening; and an intermediate section between the bolt receiving section and the cable engaging section.

18. A method of making and using a truss shoe for a mine roof, comprising the steps of:

(a) providing a one-piece body member comprising a base member having a bearing surface, an opposite surface having a bolt receiving section and a housing spaced from the bolt receiving section, the bolt receiving section having a bore terminating at the bearing surface to provide a hole in the bearing surface and a smooth bearing surface wherein a straight line along interior wall of the bore and a plane containing the bearing surface subtend an acute angle the housing having a first open end facing the bolt receiving section and a second opposite open end, with the first open end and the second open end interconnected by a passageway, wherein the open area of the passageway decreases as the distance from the first open end increases;

(b) inserting a wedge assembly in the passageway, the wedge assembly having a center hole having an expander therein and an outer surface sized and configured to slide through the first opening and not completely through the second opening; and (c) mounting a retention member over the first opening to capture the wedge assembly in passageway, the retention member having an opening greater than the diameter of the expander.

19. A method of using the truss shoe made according to the method of claim 18, comprising the steps of:

(a) securing a roof bolt assembly in a bore hole in a mine roof, (b) securing the bolt receiving section of the truss shoe to an end of the roof bolt assembly;

(c) moving a cable end through the second open end of the housing into the end of the wedge assembly against an end of the expander;

(d) moving incremental portions of the cable into the wedge assembly to move the expander through and out of the retaining member; and (e) pulling a portion of the cable out of the second opening of the passageway to move the wedge assembly toward the second opening to compress the parts of the wedge assembly against the cable to retain portions of the cable end in the passageway of the truss shoe.

20. A truss shoe for use in a mine roof support system, comprising:

a base member comprising a bearing surface for engaging a mine roof;

a body extending from the base member, the body comprising:

a bolt receiving section comprising a bore extending through the bolt receiving section and the base member, wherein the bore of the bolt receiving section has a first end opening at the bearing surface and an opposite second end opening;

a cable engaging section spaced from the bolt receiving section, the cable engaging section comprises a housing on surface of the base member opposite to the bearing surface and having a first open end facing the bolt receiving section and an opposite second open end with a passageway between the first end and the second end to receive a wedge assembly and a portion of a cable, the passageway having a cone shape with diameter decreasing as the distance from the first open end increases, and an intermediate section between the bolt receiving section and the cable engaging section.

21. The truss shoe according to claim 20, wherein the edge assembly comprises an outer cone shape and an inner circular passage, at least two discrete segments secured together by a biasing band, the wedge assembly sized to fit within the first end opening of the cable receiving section, with larger end of the wedge assembly having a greater diameter than the second opening.

22. The truss shoe according to claim 21 further comprising a tab adjacent the first end opening of the passageway having one end connected to the cable engaging section and the other end extending over a washer positioned over the first end opening of the passageway, the washer having an opening sized to retain the wedge assembly in the passageway while allowing an expander mounted in the wedge assembly to pass therethrough.

23. The truss shoe according to claim 22 further comprising a plurality of surface engaging members on inner surface of the wedge assembly and angled toward the larger end of the wedge assembly.

* * * * *